US007392734B2

(12) United States Patent
Kawabuchi et al.

(10) Patent No.: US 7,392,734 B2
(45) Date of Patent: Jul. 1, 2008

(54) ACTUATOR USING FLUID CYLINDER, METHOD OF CONTROLLING THE ACTUATOR, AND CHOKE VALVE DEVICES

(75) Inventors: Ichiro Kawabuchi, Tokyo (JP); Kiyoshi Hoshino, Ibaraki (JP)

(73) Assignees: Japan Science and Technology Agency, Kawaguchi (JP); Ichiro Kawabuchi, Tokyo (JP)

( * ) Notice: Subject to any disclaimer, the term of this patent is extended or adjusted under 35 U.S.C. 154(b) by 180 days.

(21) Appl. No.: 10/595,712

(22) PCT Filed: Nov. 8, 2004

(86) PCT No.: PCT/JP2004/016553

§ 371 (c)(1),
(2), (4) Date: Jul. 19, 2006

(87) PCT Pub. No.: WO2005/045257

PCT Pub. Date: May 19, 2005

(65) Prior Publication Data

US 2007/0039458 A1 Feb. 22, 2007

(30) Foreign Application Priority Data

Nov. 7, 2003 (JP) ..... 2003-379205

(51) Int. Cl.
*F15B 11/06* (2006.01)
*F15B 11/00* (2006.01)

(52) U.S. Cl. ..... 91/463; 91/467

(58) Field of Classification Search ..... 91/443, 91/454, 462, 463, 466, 467
See application file for complete search history.

(56) References Cited

U.S. PATENT DOCUMENTS

| | | | | |
|---|---|---|---|---|
| 2,974,637 | A * | 3/1961 | Holmes | 91/443 |
| 4,132,153 | A * | 1/1979 | Grotness et al. | 91/443 |
| 4,175,473 | A * | 11/1979 | Iizumi | 91/443 |
| 4,262,695 | A * | 4/1981 | Iizumi | 91/443 |
| 4,287,812 | A * | 9/1981 | Iizumi | 91/443 |
| 4,745,845 | A * | 5/1988 | Legris et al. | 91/443 |
| 6,279,451 | B1 * | 8/2001 | Hirano et al. | 91/443 |
| 6,802,241 | B2 * | 10/2004 | Kimura | 91/443 |

FOREIGN PATENT DOCUMENTS

| | | |
|---|---|---|
| JP | 63-254203 | 10/1988 |
| JP | 6367042 | * 10/1988 |
| JP | 03-204402 | 9/1991 |
| JP | 3-204402 | 9/1991 |
| JP | 08-093951 | 4/1996 |
| JP | 8-093951 | 4/1996 |

* cited by examiner

*Primary Examiner*—Thomas E Lazo
(74) *Attorney, Agent, or Firm*—Rankin, Hill & Clark LLP

(57) ABSTRACT

The present invention provides an actuator using a fluid cylinder capable of imparting stiffness to a fluid cylinder such as an air cylinder with a simple constitution, a control method thereof and a choke valve device. The actuator is provided with a fluid cylinder 1, a first choke valve device 3 and a second choke valve device 5. The fluid cylinder 1 has a cylinder chamber 7 and a piston 12 dispose slidably in the cylinder chamber 7 so as to partition the cylinder chamber 7 into a first chamber 9 and a second chamber 11. The first choke valve device 3 is disposed between a fluid pressure source and the first chamber 9; and the second choke valve device 5 is disposed between the fluid pressure source and the second chamber 11. Each of the choke valve devices 3 and 5 is provided with a discharge valve mechanism capable of changing the opening of the valve.

11 Claims, 15 Drawing Sheets

ACTUATOR USING FLUID CYLINDER, METHOD OF CONTROLLING THE ACTUATOR, AND CHOKE VALVE DEVICES

TECHNICAL FIELD

The present invention relates to an actuator using a fluid cylinder, control method thereof and a choke valve device used for the actuator.

BACKGROUND ART

As disclosed in the Japanese Laid-Open Patent Application No. 311667/2003, conventionally electric motor such as servomotor has been employed as an actuator for moving a joint of a robot, since motors are easily available. However, there resides such a disadvantage in motors that the entire size of robot tends to become larger. Since motors weigh considerably, design of mechanical strength of robot is also important. The fluid cylinders such as air cylinder have such advantages that, compared to motors, smaller in weight, simple in structure and easy to maintain. The fluid cylinder is estimated as useful as an actuator for robots.

Patent document 1: Japanese Patent Application Laid-Open 311667/2003

DISCLOSURE OF THE INVENTION

Problem to be Solved by the Invention

However, the following point is the largest disadvantage of the fluid cylinder such as an air cylinder that prevents its application. That is, in the fluid cylinder, it is difficult to make a piston less movable at an arbitrarily point; i.e., the performance to obtain the stiffness is poor. Primary reason of this is understood that, different from motors, since the fluid cylinder is poor in response to generate a force, a drag to maintain the position of the piston against an external force is hardly generate swiftly. As a solving means for solving the above disadvantage, a friction brake or latch may be added to the fluid cylinder. However, it would be rather reasonable to use motor only than addition of the friction brake or latch. Therefore, a method that imparts the stiffness with an extremely simple structure is required. However, as of now, no technology that responds the above request has been proposed.

An object of the present invention is to provide an actuator using a fluid cylinder and a control method thereof capable of imparting the stiffness to the fluid cylinder such as air cylinder with a simple constitution.

Another object of the present invention is to provide an actuator using a fluid cylinder capable of being constructed of a small number of component parts.

Also, another object of the present invention is to provide an actuator using a fluid cylinder capable of easily controlling the stiffness.

Further another object of the present invention is to provide a choke valve device suitable for being applied to an actuator using a fluid cylinder and a control method thereof.

Means for Solving the Problem

An actuator using a fluid cylinder in accordance with the present invention comprises a fluid cylinder and first and second choke valve devices. The fluid cylinder has a cylinder chamber and a piston slidably disposed in the cylinder chamber so as to partition the cylinder chamber into a first chamber and a second chamber. Herein, the wording "fluid cylinder" means a cylinder, which operates using pressure of a fluid as the drive source like an air cylinder, hydraulic cylinder and the like. The first choke valve device is disposed between a fluid pressure source and the first chamber to adjust the flow rate of the fluid inputted into/outputted from the first chamber. The second choke valve device is disposed between the fluid pressure source and the second chamber to adjust the flow rate of the fluid inputted into/outputted from the second chamber. Although the fluid pressure source may be provided separately to the first and second choke valve devices, it is needles to say that a common fluid pressure source may be used for the first and second choke valve devices.

In the present invention, each of the first choke valve device and the second choke valve device includes a supply valve mechanism that permits the fluid to flow in the input direction from the fluid pressure source to the corresponding chamber side and a discharge valve mechanism that permits the fluid to flow in the output direction from the chamber to the fluid pressure source side. And at least as the discharge valve mechanism, a valve mechanism, which is capable of varying the opening of the valve, is used.

When the fluid is stopped from being inputted into/outputted from the fluid cylinder and/or when the flow path of the fluid connected to the fluid cylinder is narrowed, owing to a repulsive force of the compressed fluid (spring effect) or flow resistance of the inputted/outputted fluid (damper effect), a passive drag, which functions as a resistance against the movement of the piston, is generated. Recognizing the generation of the passive drag, the present invention utilizes the passive drag to give the stiffness to the fluid cylinder. That is, in the flow path through which the fluid discharged from the first chamber and the second chamber in the fluid cylinder flows, by appropriately narrowing the flow of the fluid (chock), a drag against the movement of the piston is generated effectively. By utilizing the drag, the stiffness is given to the fluid cylinder (a state that the piston is stopped at a predetermined position and the piston is hardly moved by an external force).

For example, after the piston is shifted or moved in a certain movement direction, when the cylinder is given with the stiffness at a predetermined position, the following steps are carried out. First of all, in order to shift the piston in a certain direction, the internal pressure in one chamber has to be raised by the fluid pressure from the fluid pressure source. Therefore the supply amount (fluid pressure) of the fluid from the fluid pressure source to the chamber through one chock valve is increased. Then, the flow of the fluid discharged from other chamber is appropriately narrowed down by the choke valve device through which the fluid flows out from the other chamber at the side where the piston is shifted thereinto; thereby the stiffness is given to the fluid cylinder. By varying the opening of the valve of the discharge valve mechanism provided to the corresponding choke valve device, the flow of the fluid can be narrowed down. When the opening of the valve of the discharge valve mechanism is brought to zero or a value close to zero at an earlier timing, the piston can be stopped at earlier timing, and the fluid cylinder can be given with high stiffness. Contrarily, when the opening of the valve is appropriately narrowed (adjusted) down, the fluid cylinder is given with low stiffness.

The supply valve mechanism and the discharge valve mechanism provided to the choke valve device may be arranged as a separate structure respectively. However, such a hybrid valve mechanism that both of the supply valve mechanism and the discharge valve mechanism are included in one structure may be used.

When the supply valve mechanism and the discharge valve mechanism separated from each other are used, for example, discharge valve mechanism may be constructed of a continuously variable actuator capable of continuously varying the position of the valve, a valve position detecting means for detecting the position of the valve and control means for feedback controlling the continuously variable actuator based on the output of the valve position detecting means. When such a discharge valve mechanism is adopted, since the position of the valve is determined by means of a feedback-control, the opening of the valve can be varied swiftly with high precision.

Also, as another discharge valve mechanism in the case where the supply valve mechanism and the discharge valve mechanism separated from each other are adopted, the discharge valve mechanism having the following constitution may be employed. This discharge valve mechanism comprises valve selection control means and a plurality of different open/close valves connected in parallel to each other each of which has a discharge flow path with different cross sectional area. In the discharge operation, the valve selection control means selects at least one or more open/close valve from a plurality of different type of open/close valves and controls the selected at least one or more open/close valves to be in the open state. By arranging as described above, depending on the combination of the number and the kinds of the selected open/close valve, a plurality of different valve openings (conditions narrowing the fluid path) are obtained swiftly with high precision by using a small number of open/close valves, and are graded into levels. As for the plurality of different open/close valves used, by using a plurality of different valves, of which cross sectional area of the discharge flow path of $2^n$(n=0, 1, 2, 3, . . . ) times of the minimum cross sectional area, maximum opening levels can be obtained within the combination of the number of the disposed open/close valves.

Further, as a hybrid type discharge valve mechanism, for example, a first type hybrid discharge valve mechanism in which a valve seat block, a valve plug and a stationary block are combined with each other may be employed. The valve seat block has a discharge path with a constant width and a supply path with a gradually varying width, which are disposed in parallel to each other. The valve plug has a flow path and a large flow path, which is continuously formed with the flow path and has a cross sectional area larger than that of the flow path, and is arranged slidably with respect to the valve seat block. The position of the valve plug is controlled so that, in supplying operation, the supply path is fully opened and the discharge flow path is completely closed; and in discharging operation, the supply path is completely closed and the flow path communicates with the discharge path; thereby the communication area between the discharge path and the flow path can be continuously varied. The stationary block has a small flow path with a cross sectional area smaller than that of the large flow path, which is constantly communicated with the large flow path irrespective of the position of the valve plug. In the hybrid discharge valve mechanism as described above, both of the supply valve mechanism and the discharge valve mechanism can be constructed within one mechanism using a small number of component parts with a simple structure.

The above-described valve mechanism can be practically constructed in a small size. Accordingly, each of the supply valve mechanism and the discharge valve mechanism can be adjacently disposed at the both side of the fluid cylinder. As a result, fluid tubes between the fluid pressure source and the valve mechanisms can be eliminated.

Also, as a second hybrid discharge valve mechanism, the following constitution may be adopted. That is, the second hybrid discharge valve mechanism comprises a pressure control valve mechanism; a one-way valve mechanism that permits the fluid to flow only in the input direction from the fluid pressure source to the corresponding chamber side through the pressure control valve mechanism; and a two-way valve mechanism that permits the fluid to flow in the two directions; i.e., in the input direction from the fluid pressure source to the chamber side through the pressure control valve mechanism and in the output direction from the chamber to the fluid pressure source side, wherein the two-way valve mechanism is arranged so that the opening of the valve can be varied depending on the pressure of the fluid supplied from the fluid pressure source. When the hybrid valve mechanism, which has the two-way valve mechanism as described above, is used, in one choke valve device in which the fluid is positively supplied to the corresponding chamber to shift the piston of the fluid cylinder, the fluid is supplied to the chamber through both of the one-way valve mechanism and the two-way valve mechanism. In this state, in the other choke valve device, since the one-way valve mechanism is in the closed state, by adjusting the opening of the two-way valve mechanism to appropriately narrow the flow of the fluid in the output direction, the fluid cylinder can be given with appropriate stiffness. In more particular, when the fluid is stopped from being inputted to/outputted from the fluid cylinder, or when the flow path of the fluid connected to the fluid cylinder is narrowed, owing to the repulsive force (spring effect) of the compressed fluid and the flow resistance (damper effect) of the inputted/outputted fluid, a passive drag, which functions as a resistance against the movement of the piston, is generated. Recognizing the generation of the passive drag, the present invention utilizes the drag to give the stiffness to the fluid cylinder. That is, a drag against the movement of the piston is generated effectively by appropriately narrowing the flow of the fluid (chock) in the flow path through which the fluid discharged from or inputted into the first chamber and the second chamber in the fluid cylinder flows. By utilizing the drag, the stiffness is given to the fluid cylinder (a state that the piston is stopped at a predetermined position and the piston is hardly moved by an external force).

For example, when the fluid cylinder is given with stiffness at a predetermined position after the piston is moved in a certain movement direction, the supply amount (fluid pressure) of the fluid from the fluid pressure source at the side of one choke valve, which is provided to the chamber that internal pressure has to be raised to shift the piston, is increased. The stiffness is given to the fluid cylinder by suitably narrowing the flow of the fluid in the chock valuve device, into which the fluid flows out of the chamber positioned in the direction toward which the piston is moved. The narrowing is realized by adjusting the opening of the two-way valve mechanism which is controlled by varying the pressure of the fluid supplied from the fluid pressure source to the choke valve device. When the pressure is raised, the piston is stopped at an earlier timing, and the fluid cylinder is given with high stiffness. Contrarily, when the pressure is lowered, the piston moves at a high speed, and the fluid cylinder is given with low stiffness. In this description, the function as described above is defined as a function to automatically reduce the cross sectional area of the flow path based on the fluid pressure. Also, to move the piston at a high speed, a large amount of highly pressurized air has to be flowed into one chamber of the fluid cylinder. Therefore, in the present invention, a one-way valve mechanism for permitting the fluid to flow in or to be supplied freely to the chamber is provided to the two-way valve mechanism as a bypassing means.

If the opening is adjustable by means of the pressure of the fluid supplied from the fluid pressure source, the two-way valve mechanism may employ any constitution. However, to reduce the entire weight and simplify the structure, a spring member is preferably employed. Therefore, the two-way valve mechanism may be constructed of a rod equipped with a moving needle; a restriction member having a through hole through which the moving needle movably penetrates, and in which the flow rate of the fluid passing through the through hole is controlled depending on the position of the moving needle; a spring member that constantly applies an energizing force for shifting the moving needle to the rod in the direction that the fluid passing through the through hole increases; a fluid-driven rod shifting mechanism that causes the rod to shift against the energizing force of the spring member by means of a pressure of the fluid supplied from the fluid pressure source to shift the moving needle in the direction that the flow rate of the fluid passing through the through hole of the restriction member decreases; and a spring member mounting structure capable of changing the number of turns within a section in the spring member which functions as a compressed spring. By causing the rod to move to shift the moving needle within the through hole of the restriction member, the flow rate of the fluid flowing through the through hole in the two directions can be easily adjusted.

The choke valve device may have such a constitution that a device body has a first connection port connected to the corresponding chamber, a second connection port, which is connected to the fluid pressure source and an inner flow path positioned between the first connection port and the second connection port through which the fluid flows, and a spring member mounting structure for mounting the spring member to the device body. The restriction member and a part of the rod equipped with the moving needle are disposed within the inner flow path of the device body. And, preferably, a valve of the one-way valve mechanism is provided to a peripheral portion of the restriction member. The valve is positioned between an inner wall portion of the device body enclosing the inner flow path and the peripheral portion. The valve operates by means of the inner wall portion as the valve seat. By adopting such a constitution, the two-way valve mechanism and the one-way valve mechanism can be disposed concentrically; and thus, the valve mechanism can be structured compactly and simply.

If a drag against the energizing force of the spring member can be worked on the rod by using the pressure of the fluid, the fluid-driven rod shifting mechanism may adopt any structure. For example, the fluid-driven rod shifting mechanism may comprise a cylinder section communicated with an inner flow path of the device body; a piston section provided to the rod. The position section is slidable within the cylinder section. By arranging as described above, since the fluid-driven rod shifting mechanism can be constructed along the rod, the dimension of the device body can be prevented from becoming too large.

The spring member mounting structure may be structured so that the energizing force of the spring member works on the outer portion of the rod extending from the cylinder section. In particular, a coil spring member may be employed as the spring member. The coil spring has the internal end at the device body side and the external end at the external end side of the rod and is disposed in a compressed state. The spring member mounting structure has a cylindrical member, which is positioned inside the coil spring member and fixed to the outer portion of the rod so as to move along with the rod. The cylindrical member is provided with an engaging portion to be engaged with the internal end of the coil spring member. The spring member mounting structure also has a spring member intermediate portion holding structure, which is positioned at the outer side of the cylindrical member and is arranged so as not to shift with respect to the device body and so as to hold a intermediate portion of the coil spring member. Here, the spring member intermediate portion holding structure is preferably constructed in such a manner that the length of the coil spring member held between the engaging portion and the structure can be adjusted by varying the holding position of the intermediate portion of the coil spring member. By arranging as described above, in accordance with the purpose of the actuator, the number of turns of the applied coil spring member can be easily adjusted; and thus, the controlling characteristic of the actuator can be arbitrarily adjusted. Herein, the wording "number of turns of the coil spring member" means the number of coil wire that can be seen on the surface of the coil spring member of a coil wire formed into a spiral state. When the number of turns of the coil spring member disposed in an identical range is reduced, the coil spring member becomes stiffer, the narrowed amount of the flow path corresponding to the pressure of the fluid supplied from the fluid pressure source becomes smaller.

The spring member end holding structure is preferably structured so as to have a wedge member that is inserted between two neighboring turn portions of the coil spring member. The wedge member is disposed so as to allow the coil spring member to be rotated on the cylindrical member. When the coil spring member is rotated, the relative position of the wedge member with respect to the coil spring member is changed. As a result, by changing the number of turns of the coil spring member positioned between the wedge member and the engaging portion, the compressed force of the coil spring member can be easily adjusted continuously.

A second connecting port is disposed so as to be communicated with the flow path positioned between the restriction member and the cylinder section. By disposing as described above, the valve mechanism and the fluid-driven rod shifting mechanism can be disposed at the both sides of the second connecting portion along the rod, and the choke valve device can be constructed compactly.

In a control method of the actuator using the fluid cylinder of the present invention, when the fluid is positively supplied from the fluid pressure source into the cylinder chamber from one of the first and second choke valve devices to move the position of the piston of the fluid cylinder, the mobility of the piston in the fluid cylinder by an external force; i.e., the stiffness is determined by restricting the flow rate of the fluid toward the output direction of the discharge valve mechanism in the other of the first and second choke valve devices.

Also, in a control method of the actuator employing the fluid cylinder of the present invention using the above-described second type hybrid valve mechanism, when the fluid is positively supplied from the fluid pressure source into the cylinder chamber from the first and second choke valve devices to move the position of the piston of the fluid cylinder, the stiffness of the piston is determined by restricting the flow rate of the fluid toward the output direction of the two-way valve mechanism of the first and second choke valve devices. Also, in this method, the position of the fluid cylinder can be stopped by positively supplying the fluid from the fluid pressure source to the choke valve device which is at the output direction side to move the piston section provided to the rod to positively shut down the through hole of the restriction member with the moving needle, the piston of the fluid cylinder can be stopped. According to the control method, by adjusting the opening of the two-way valve mechanism of the first and second choke valve device, the stiffness and the stop position of the fluid cylinder can be easily determined arbitrarily.

BEST MODE FOR IMPLEMENTING THE INVENTION

Figure 1:
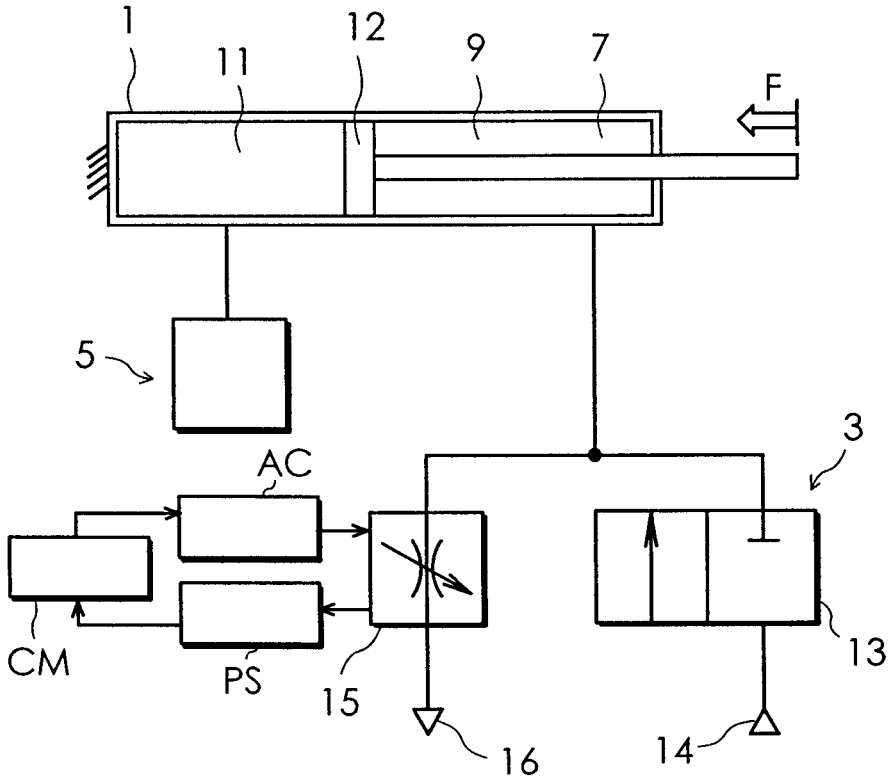
FIG. 1 is a schematic diagram of a first embodiment of an actuator in which a fluid cylinder in accordance with the present invention is employed.

Hereinafter, embodiments of the present invention will be described with reference to the drawings. FIGS. 1 to 3 and FIG. 8 are schematic diagrams each schematically showing the constitution of first to fourth embodiments of an actuator in which a fluid cylinder in accordance with the present invention is employed.

First of all, points common to the actuators in the first to fourth embodiments will be described. The actuator that employs the fluid cylinder in accordance with the first to fourth embodiments comprises a fluid cylinder 1, a first choke valve device 3, 103, 203, 303 and a second choke valve device 5, 105, 205, 305. The fluid cylinder 1 has a cylinder chamber 7 and a piston 12 slidably disposed in the cylinder chamber 7 so as to partition the cylinder chamber 7 into a first chamber 9 and a second chamber 11. In this embodiment, description will be made assuming that an air cylinder is used as the fluid cylinder 1. However, it is needless to say that, as for the fluid cylinder 1, the cylinder using a pressure of a fluid as the drive source, such as a hydraulic cylinder or the like may be used.

The first choke valve device 3, 103, 203, 303 is disposed between a fluid pressure source (not shown) and the first chamber 9 to adjust the flow rate of the fluid coming in/going out from the first chamber 9. Here, the fluid pressure source is constructed so as to receive the fluid flowing out from the first chamber 9, when the pressure in the first chamber 9 becomes larger than the pressure of the fluid supplied from the fluid pressure source. Also, the second choke valve device 5, 105, 205, 305 is disposed between the fluid pressure source and the second chamber 11 to adjust the flow rate of the fluid coming in/going out from the second chamber 11. Note that since the second choke valve device 5, 105, 205, 305 has the same structure and functions the same working as that of the first choke valve device 3, 103, 203, 303, the second choke valve device 5, 105, 205, 305 is indicated with a simple block figure omitting its details. Therefore, in the following descriptions, the constitution of the first choke valve device 3, 103, 203, 303 will be described; but the description of the second choke valve device 5, 105, 205, 305 will be omitted.

In the embodiments of the present invention, the fluid pressure source is provided to each of the first and second choke valve devices 3, 103, 203, 303 and 5, 105, 205, 305 separately. However, a single common fluid pressure source may be used for the first and second choke valve devices 3, 103, 203, 303 and 5, 105, 205, 305. In the case where a single common fluid pressure source is used, only a switching means has to be provided between the common fluid pressure source and the first and second choke valve devices 3, 103, 203, 303 and 5, 105, 205, 305.

FIG. 1 is a diagram schematically showing a constitution of an actuator that employs the fluid cylinder in accordance with the first embodiment of the present invention. As shown in FIG. 1, each of the first choke valve device 3 and the second choke valve device 5 comprises a supply valve mechanism 13 that permits the fluid to flow in the input direction from the fluid pressure source (not shown) to the corresponding chamber and a discharge valve mechanism 15 that permits the fluid to flow in the output direction from the chamber to the fluid pressure source. Each of the supply valve mechanism 13 and the discharge valve mechanism 15 has a supply port 14 and a discharge port 16 respectively for inputting and outputting the fluid. In this embodiment, the discharge valve mechanism 15 is arranged so as to vary the opening of the valve. In this embodiment, in order to vary the opening of the valve, the discharge valve mechanism 15 is provided with a continuously variable actuator AC capable of continuously varying the position of the valve, a valve position detecting means PS for detecting the position of the valve and a control means CM. The control means CM feedbacks the output of the valve position detecting means PS to control the continuously variable actuator AC based thereon. When the constitution as described above is employed, a repulsive force (spring effect) of the compressed fluid and flow resistance (damper effect) of the inputted/outputted fluid are generated by stopping the input/output of the fluid with respect to the fluid cylinder 1; or by narrowing the flow path for the fluid connected to the fluid cylinder 1. Therefore a passive drag which functions as a resistance against the movement of the piston 12 can be generated. In the embodiments of the present invention, the drag is utilized as the stiffness of the fluid cylinder. That is, the drag against the movement of the piston 12 is generated effectively by appropriately narrowing (chokeing) the flow of the discharged fluid in the flow path through which the fluid discharged from the first chamber 9 and the second chamber 11 in the fluid cylinder 1 flows. Therefore the stiffness can be given to the fluid cylinder 1 by utilizing the drag (the piston 12 stops at a predetermined position and the piston 12 can be brought into a state to be hardly moved by an external force.)

For example, to generate a stiffness at a predetermined position after the piston 12 has been moved from the second chamber 11 to the first chamber 9 side, first of all, the supply amount (fluid pressure) of the fluid from the fluid pressure source for the second choke valve device 5 is increased to raise the internal pressure in the second chamber 11. Then, by appropriately adjusting the opening of the valve of the discharge valve mechanism in the first choke valve device 3, through which the fluid flows out from the first chamber 9 which the piston 12 is caused to shift thereinto, the flow of the fluid is appropriately choked; and thus, a stiffness is given to the fluid cylinder. The flow of the fluid can be narrowed by driving the continuously variable actuator AC to continuously operate based on the control command from the control means CM to adjust the opening of the valve of the discharge valve mechanism 15 provided in the first choke valve device 3. When the opening of the valve of the discharge valve mechanism 15 is brought to zero or a value close to zero at an earlier timing, the piston 12 can be stopped at an earlier timing and the fluid cylinder 1 can be given with a higher stiffness. Contrarily, when the opening of the valve is appropriately reduced (adjusted), the fluid cylinder can be given with a lower stiffness. In this embodiment, only the discharge valve mechanism 15 is arranged so that the opening of the valve can be varied. However, this arrangement may be provided not only to the discharge valve mechanism 15 but also to the supply valve mechanism 13. By adopting such arrangement, the fluid can be controlled to be inputted/outputted at a higher accuracy; and thus a desired stiffness can be given to the fluid cylinder 1.

Figure 2:
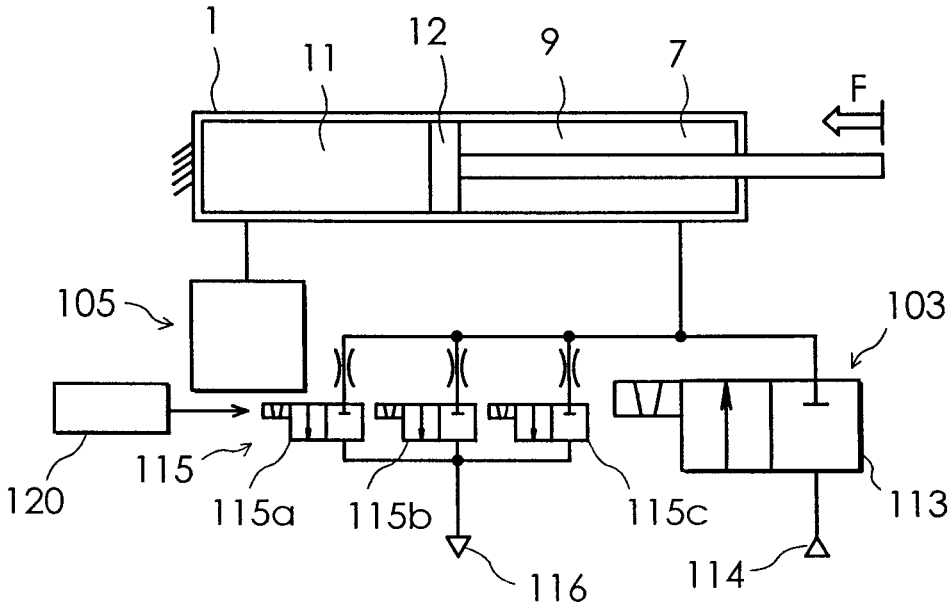
FIG. 2 is a schematic diagram of a second embodiment of an actuator in which the fluid cylinder in accordance with the present invention is employed.
Figure 3:
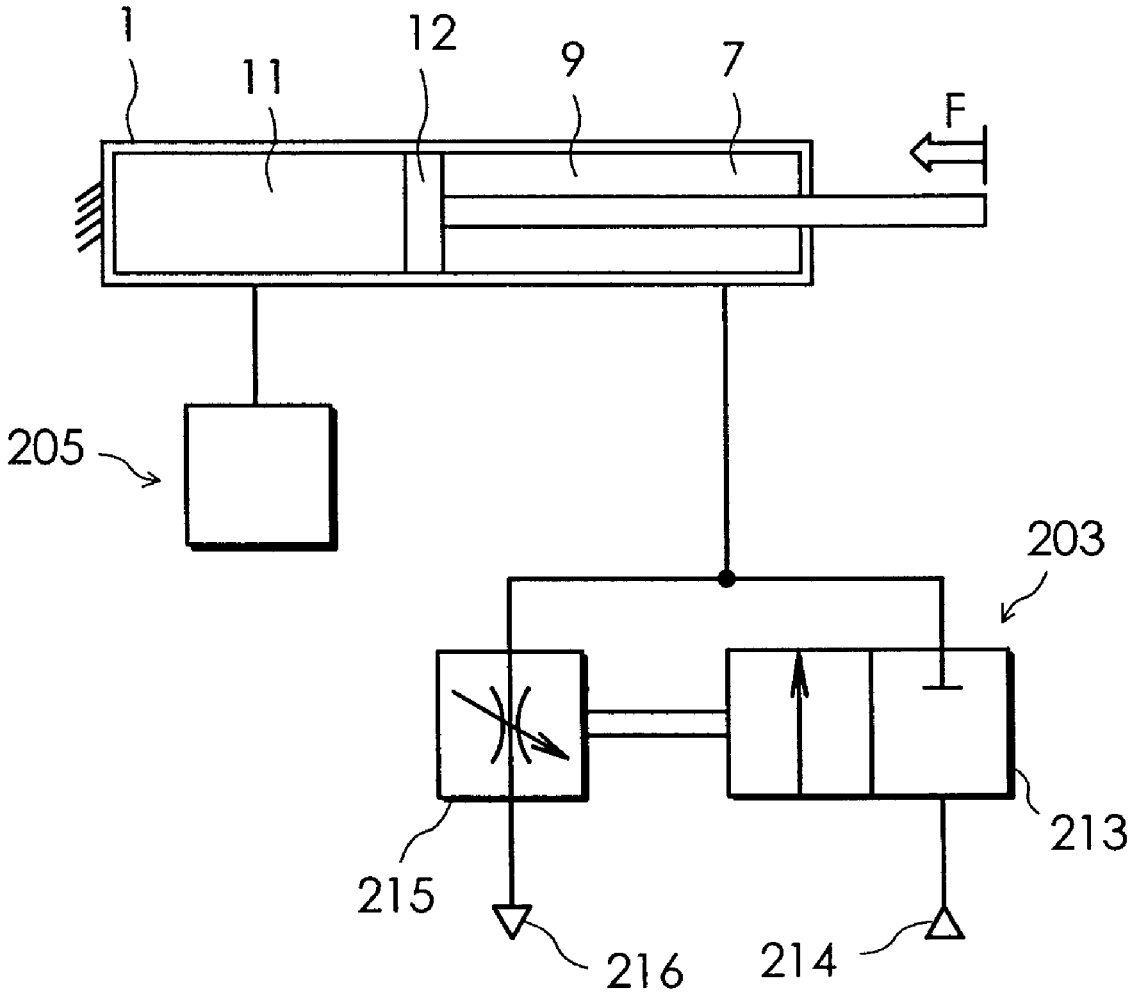
FIG. 3 is a schematic diagram of a third embodiment of an actuator in which the fluid cylinder in accordance with the present invention is employed.
Figure 4A:
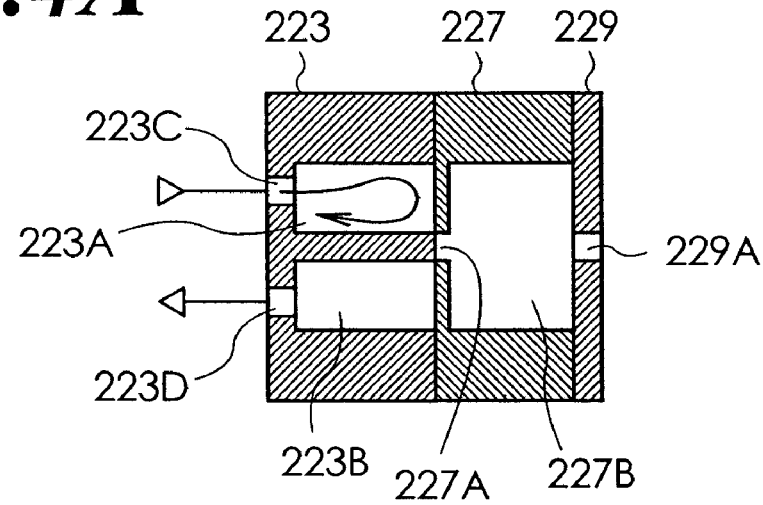
FIG. 4A is a sectional view showing a half part of a hybrid valve mechanism (valve seat block, valve plug and stationary block) used in the third embodiment in FIG. 3 in a state that supply/discharge operation is stopped.
Figure 4B:
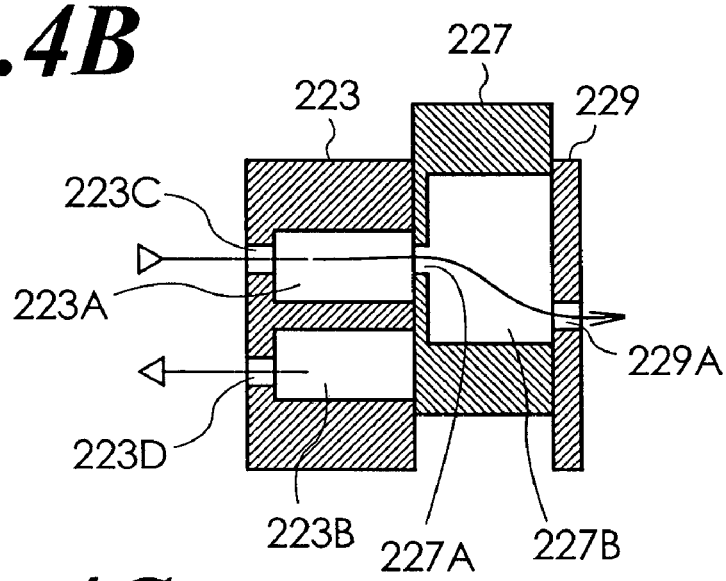
FIG. 4B is a s sectional view showing a half part of the hybrid valve mechanism (valve seat block, valve plug and stationary block) used in the third embodiment in FIG. 3 in a state of supply operation.
Figure 4C:
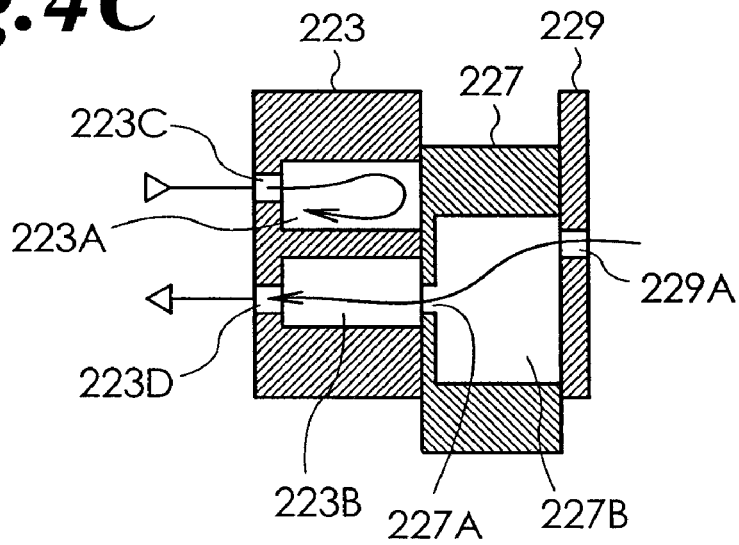
FIG. 4C is a sectional view showing a half part of the hybrid valve mechanism (valve seat block, valve plug and stationary block) used in the third embodiment in FIG. 3 in a state of discharge operation.
Figure 5A:
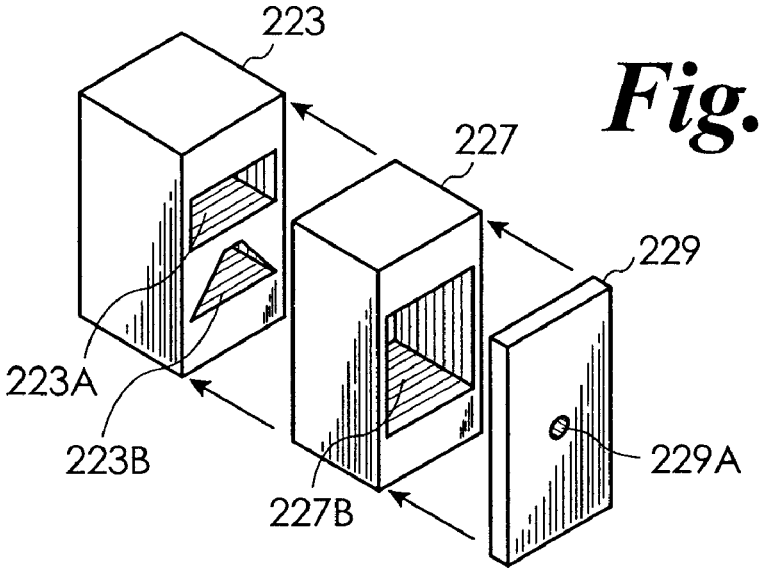
FIG. 5A is an exploded perspective view of the hybrid valve mechanism (valve seat block, valve plug and stationary block) in FIG. 3.
Figure 5B:
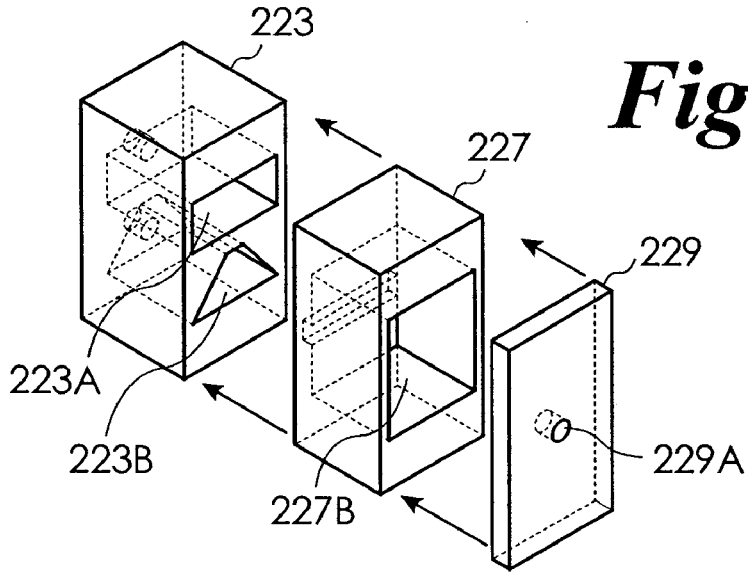
FIG. 5B is an exploded clairvoyant perspective view showing the inside of the hybrid valve mechanism in FIG. 5A.
Figure 5C:
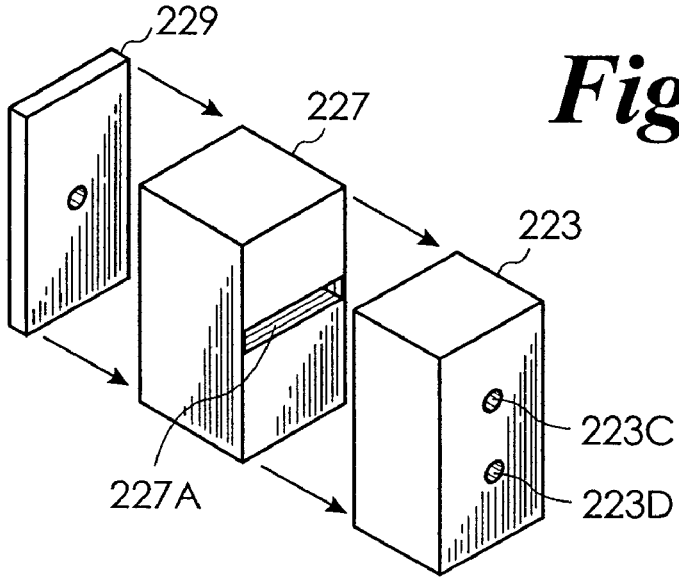
FIG. 5C is an exploded perspective view viewed from a direction 180° different from that in FIG. 5A.
Figure 6A:
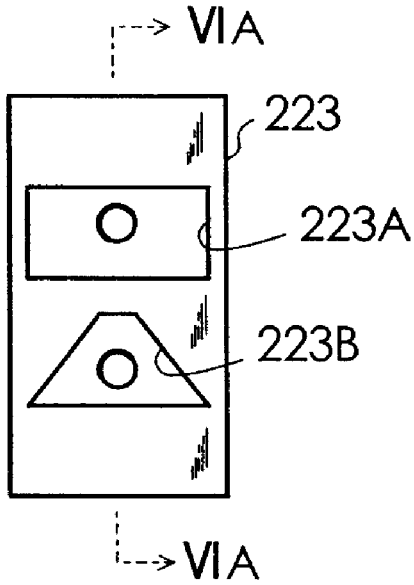
FIG. 6A is a view of the valve seat block in FIG. 5A viewed from the valve plug side.
Figure 6B:
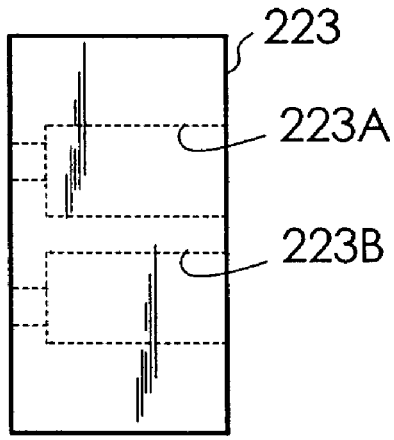
FIG. 6B is a cross sectional view of the valve seat block in FIG. 6A taken along line VIA-VIA.
Figure 7A:
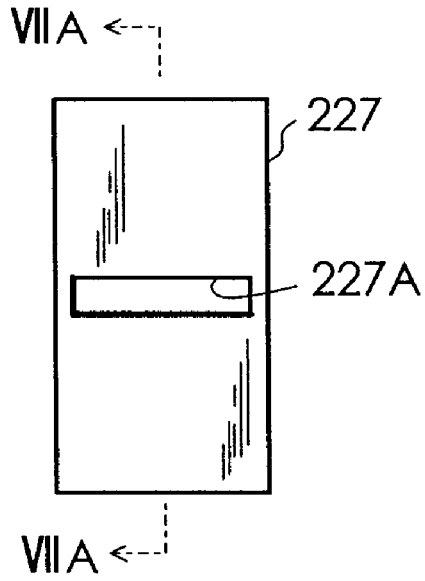
FIG. 7A is a view of the valve plug in FIG. 5A viewed from the valve seat block side.
Figure 7B:
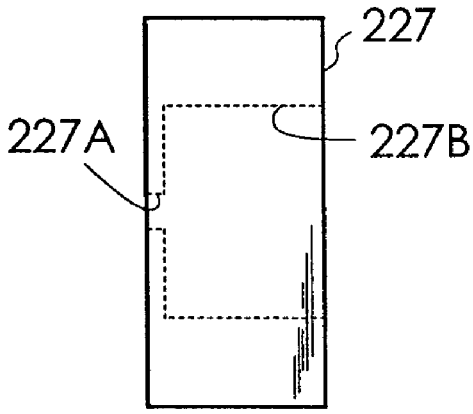
FIG. 7B is a cross sectional view of the valve plug in FIG. 7A taken along line VIIA-VIIA.
Figure 8:
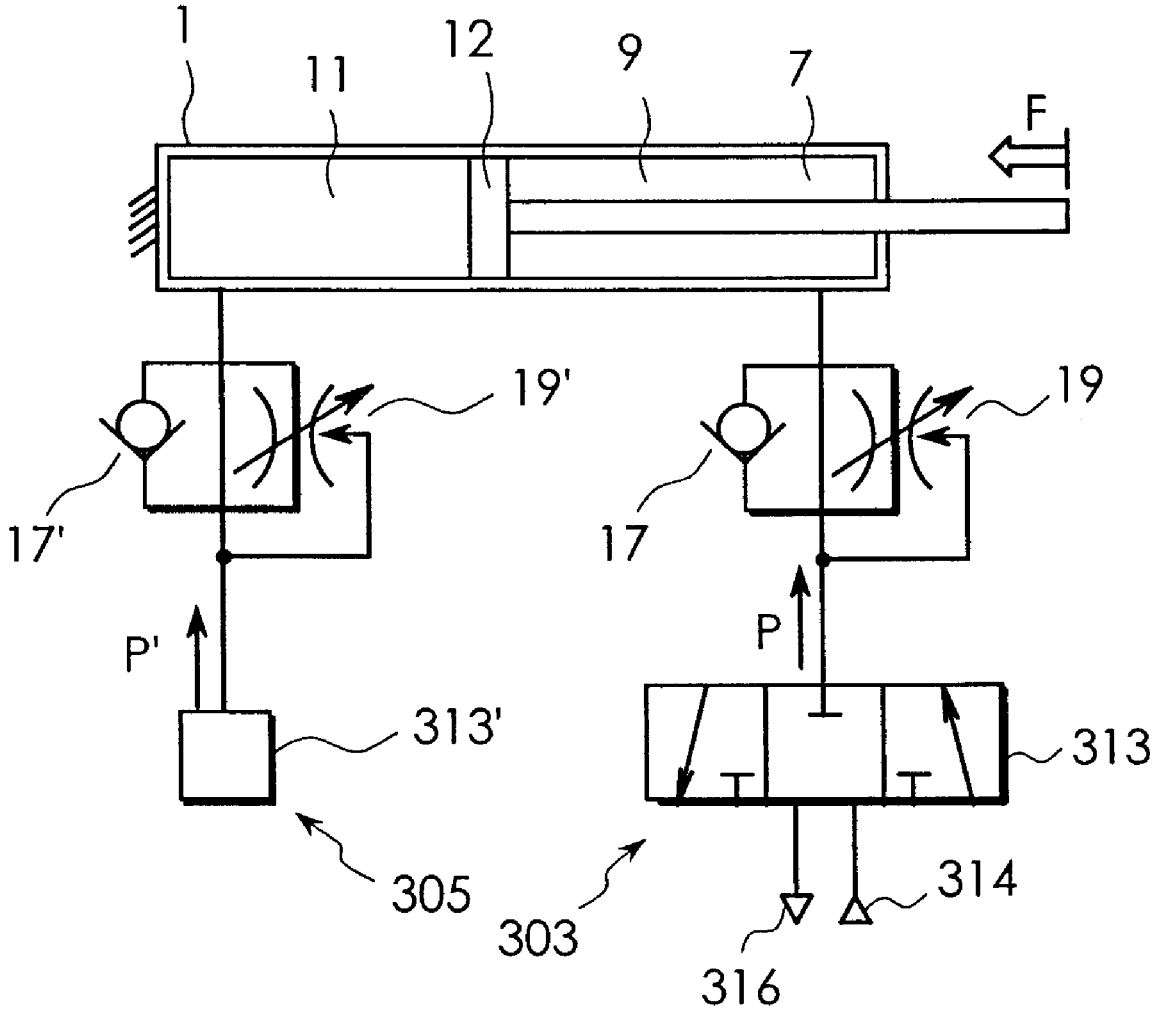
FIG. 8 is a schematic diagram of a fourth embodiment of an actuator using the fluid cylinder in accordance with the present invention.

FIG. 2 shows a second embodiment of the present invention, in which, same as the first embodiment, separate supply valve mechanism and discharge valve mechanism are used. Note that, in FIG. 2, the constitutions, which are identical to those of the first embodiment shown in FIG. 1, are given with the reference numerals used in FIG. 1 appendixed with 100, and the some descriptions thereof are omitted excluding the constitution of the fluid cylinder. In this embodiment, the discharge valve mechanism 115 comprises a plurality of different kind open/close valves 115*a*, 115*b* and 115*c*, which are connected in parallel to each other and have the different cross sectional area of the discharge flow path from each other, and a valve selection control means 120. Also, the supply valve mechanism 113 and the discharge valve mechanism 115 have a supply port 114 and a discharge port 116 for inputting/outputting the fluid. When discharging, the valve selection control means 120 selects at least one or more open/close valves from the plural kinds of open/close valves 115*a*, 115*b* and 115*c*, and controls the selected open/close valves to be in an open state. Owing to this, depending on the combination of number and kinds of the selected open/close valves, a plurality of valve openings (narrowed condition of the fluid path) can be obtained in levels using a small number of open/close valves. Each of the plural kinds of open/close valves, for example, may have the cross sectional area of the discharge flow path which is $2^n$ (n=0, 1, 2, 3, . . . ) times as wide as the minimum cross sectional area. In this embodiment, the ratio of the cross sectional areas in the three open/close valves is 1:2:4 respectively [$2^n$ (n=0, 1, 2, 3, . . . ) times as wide as the minimum cross sectional area]. In this case, the discharge amount of the fluid can be adjusted in a ratio of 0:1:2:3:4:5:6:7 only by opening and/or closing the respective open/close valves. That is, if n+1 open/close valves are used and the valves are selectively opened and/or closed, $2^{n+1}$ kinds of discharge amount can be set in multiple levels. Accordingly, the discharge flow rate and the stiffness can be adjusted at a high speed with high precision.

FIGS. 3 to 7 are drawings schematically showing constitutions of actuator of a third embodiment using the fluid cylinder. The third embodiment employs a hybrid discharge valve mechanism. As shown in FIGS. 4 to 7, this embodiment employs a first hybrid discharge valve mechanism 203 and a second hybrid discharge valve mechanism 205, which are constructed by combination of a valve seat block 223, a valve plug 227 and a stationary block 229. Each of the first and second hybrid discharge valve mechanisms 203 and 205 has a supply port 214 and a discharge port 216 for inputting/outputting the fluid.

Referring to FIGS. 4A to 7B, structure and operation of the hybrid discharge valve mechanism 203 will be described below. The valve seat block 223 has a supply path 223A and a discharge path 223B, which are disposed in parallel to each other; the supply path 223A has a constant path width, and the discharge path 223B has a path of which width varies gradually. In particular, the supply path 223A is formed so as to include a cuboid-shaped space within the valve seat block 223. On the other hand, the discharge path 223B is formed so as to include a space having a trapezoidal shape in section, in which the side opposite to the supply path 223A is the upper base and the opposite side thereof is the lower base (FIG. 5B). A supply port 223C and a discharge port 223D each communicating with the supply path 223A and the discharge path 223B are formed at the side opposite to the surface contacting with the valve plug 227 (which will be described later). The valve plug 227 includes a flow path 227A and a large flow path 227B. The large flow path 227B is formed continuously with the flow path 227A and the cross sectional area thereof is larger than that of the flow path 227A. The valve plug 227 is provided slidably with respect to the valve seat block 223. The position of the valve plug 227 is controlled so that, when supplying the fluid, the supply path 223A is fully opened and the discharge path 223B is completely closed (FIG. 4B); when discharging the fluid, the supply path 223A is completely closed (FIG. 4A); and the communication area between the discharge path 223B and the flow path 227A can be varied continuously. The stationary block 229 includes a small flow path 229A having a cross sectional area smaller than that of the large flow path 227B and constantly communicated therewith irrespective of the position of the valve plug 227. The supply port 223C and the discharge port 223D have substantially the same diameter and shape as those of the small flow path 229A. By employing the hybrid discharge valve mechanism in accordance with the third embodiment, both of the supply valve mechanism and the discharge valve mechanism can be included therein with a small number of component parts and a simple structure.

FIGS. 8 to 14 are diagrams showing a fourth embodiment of the present invention, which has a second hybrid discharge valve mechanism. This embodiment includes a pressure control valve mechanism 313, 313', a one-way valve mechanism 17, 17' and a two-way valve mechanism 19, 19' that permits the fluid to flow in the two directions. The one-way valve mechanism 17, 17' permits the fluid to flow only in the input direction toward the corresponding chamber side from the fluid pressure source (not shown) through the pressure control valve mechanism 313, 313'. The two-way valve mechanism 19, 19' permits the fluid to flow in the two directions; i.e., in the input direction toward the chamber from the fluid pressure source through the pressure control valve mechanism 313, 313' and in the output direction toward the fluid pressure source from the chamber. The pressure control valve mechanism 313, 313' is comprised of a supply/discharge valve that integrally includes a supply valve and a discharge valve. Each of the supply valve and the discharge valve performs supplying and discharging of the fluid in one way respectively with respect to the fluid pressure source. And the supply valve and the discharge valve are provided with a supply port 314 for supplying the fluid and a discharge port 316 for discharging the fluid.

In this case, the two-way valve mechanism 19, 19' may be constructed so as to vary the opening of the valve with the pressure of the fluid supplied from the fluid pressure source (not shown). When the hybrid valve mechanism having a two-way valve mechanism as described above is employed, in the choke valve device in which the fluid is positively supplied to the corresponding chamber to move the piston 12 in the fluid cylinder 1, the fluid is supplied to the chamber through both of the one-way valve mechanism and the two-way valve mechanism. The one-way valve mechanism 17, 17 permits the fluid to flow only in the input direction from the fluid pressure source to the corresponding chamber 9, 11. The two-way valve mechanism 19, 19' is constructed so as to permit the fluid to flow in the two directions; i.e., in the input direction from the fluid pressure source (not shown) to the chamber 9, 11 side, and in the output direction from the chamber 9, 11 to the fluid pressure source side, and so as to adjust the opening of the valve by the pressure of the fluid supplied from the fluid pressure source. When the choke valve devices 303, 305 having the two-way valve mechanism 19, 19' as described above are employed, in one of the choke valve devices 303, 305 that positively supplies the fluid to the corresponding chamber 9, 11 to move the piston 12 in the fluid cylinder 1, the fluid is supplied to the chamber 9, 11 through both of the one-way valve mechanism 17, 17' and the two-way valve mechanism 19, 19'.

In this state, in the other one of the choke valve device 303, 305, the one-way valve mechanism 17', 17 is in the closed state. By adjusting the opening of the two-way valve mechanism 19', 19 to appropriately narrow down the flow of the fluid in the output direction, appropriate stiffness can be given to the fluid cylinder 1. That is, by stopping the input/output of the fluid with respect to the fluid cylinder 1 and narrowing down the flow path of the fluid connected to the fluid cylinder 1, the repulsive force (spring effect) of the compressed fluid (in this example, air) and the flow resistance (damper effect) of the inputted/outputted fluid (in this example, air) is generated, thereby, a passive drag which functions as resistance against the movement of the piston 12 is generated. As a result, a stiffness can be given to the fluid cylinder 1 by utilizing the drag against the movement of the pistion 12 which is effectively generated by controlling the flow of the fluid to appropriately narrow down (choke) in the flow path through which the fluid flows to be supplied to/discharged from the first chamber 9 and the second chamber 11 in the fluid cylinder 1. Therefore, the piston 12 can be stopped at a predetermined position, and such a state that the piston 12 can be hardly or never moved by an external force.

For example, in the case where the stiffness is given at a predetermined position after the piston 12 being moved in the direction from the second chamber 11 toward the first chamber 9, the internal pressure of the second chamber 11 must be increased. Then the supply amount (fluid pressure) of the fluid from the fluid pressure source at a side of the second choke valve 305 provided to the second chamber 11 is increased; and the flow of the fluid through the first choke valve device 303 which receives the fluid out from the first chamber 9 where the piston 12 is moved to come into, is appropriately narrowed down by the first check valve device to give a stiffness to the fluid cylinder 1. The opening of the two-way valve mechanism 19, 19' can be adjusted by varying the pressure of the fluid supplied from the fluid pressure source to the choke valve device. When the pressure is increased, the piston 12 can be stopped at an earlier timing and the fluid cylinder 1 can be given with a high stiffness. Contrarily, when the pressure is decreased, the piston 12 can be moved at a high speed, and the fluid cylinder 1 is given with a low stiffness. Also, to cause the piston 12 to move at a high speed, a large amount of the fluid (air) with a high pressure has to be flown into the other chamber 9, 11 in the fluid cylinder 1. Therefore, in this embodiment, the one-way valve mechanism 17, 17' for allowing the fluid to freely flow or to be supplied to the chamber 9, 11 is provided in parallel to the two-way valve mechanism 19, 19' as a bypass means.

Figure 9:
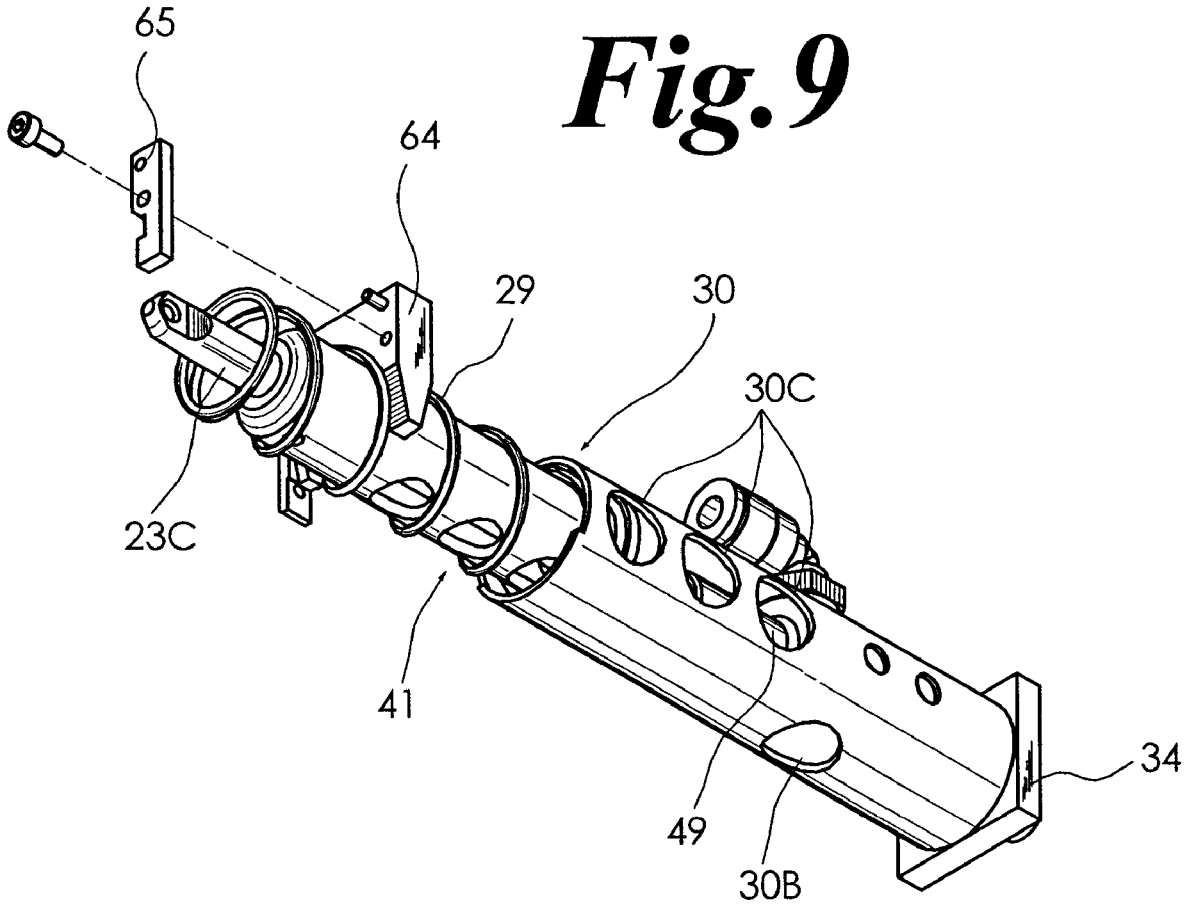
FIG. 9 is a perspective view of a choke valve device (one-way valve mechanism and two-way valve mechanism) used in the fourth embodiment of the present invention in FIG. 8, a part of which is exploded.
Figure 10A:
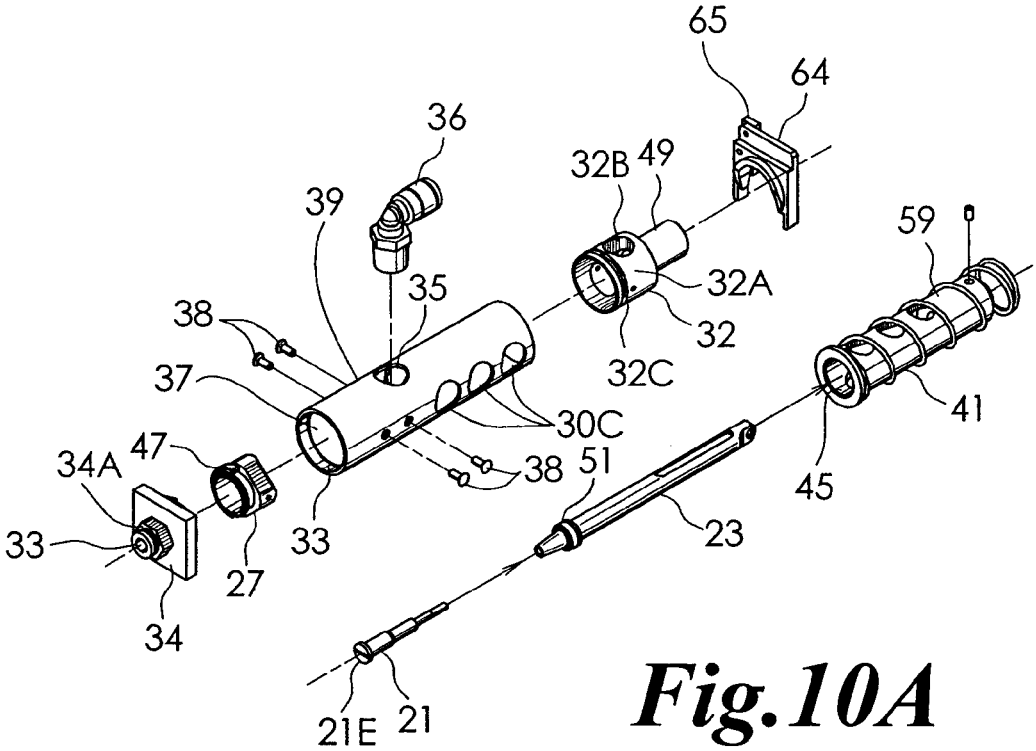
FIG. 10A is an exploded perspective view of the choke valve device (one-way valve mechanism and two-way valve mechanism) used in the fourth embodiment in FIG. 8.
Figure 10B:
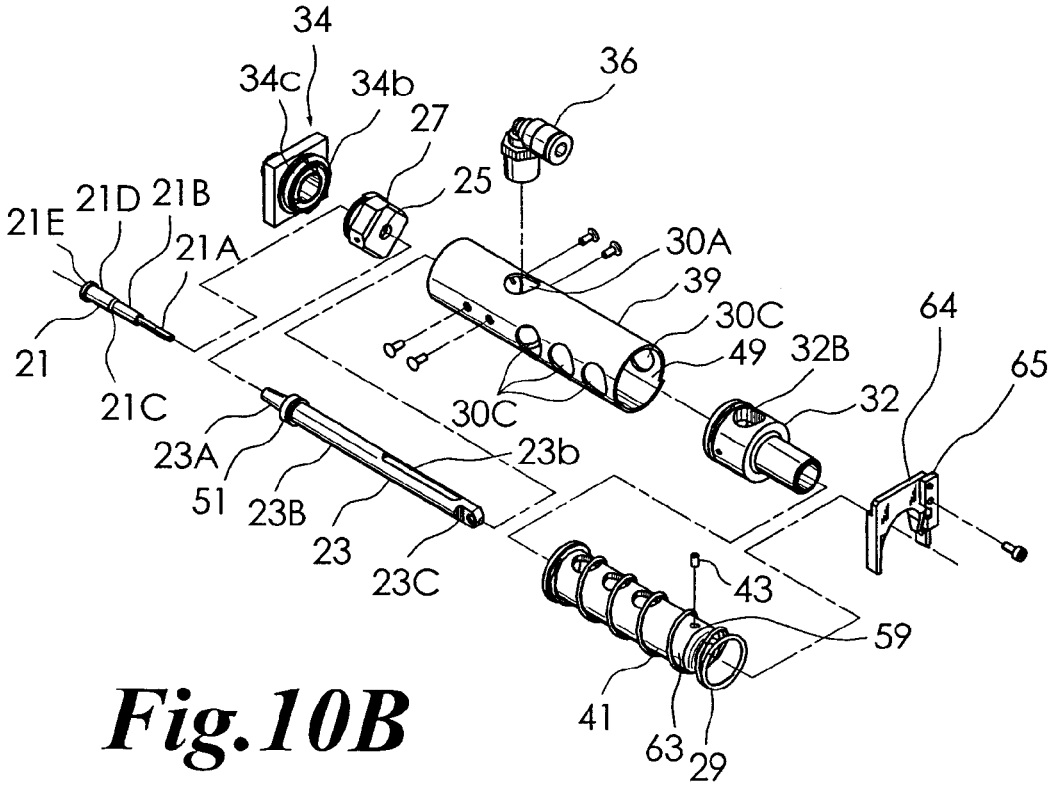
FIG. 10B is an exploded perspective view of the choke valve device viewed from the direction 90° different from that in FIG. 10A.
Figure 11A:
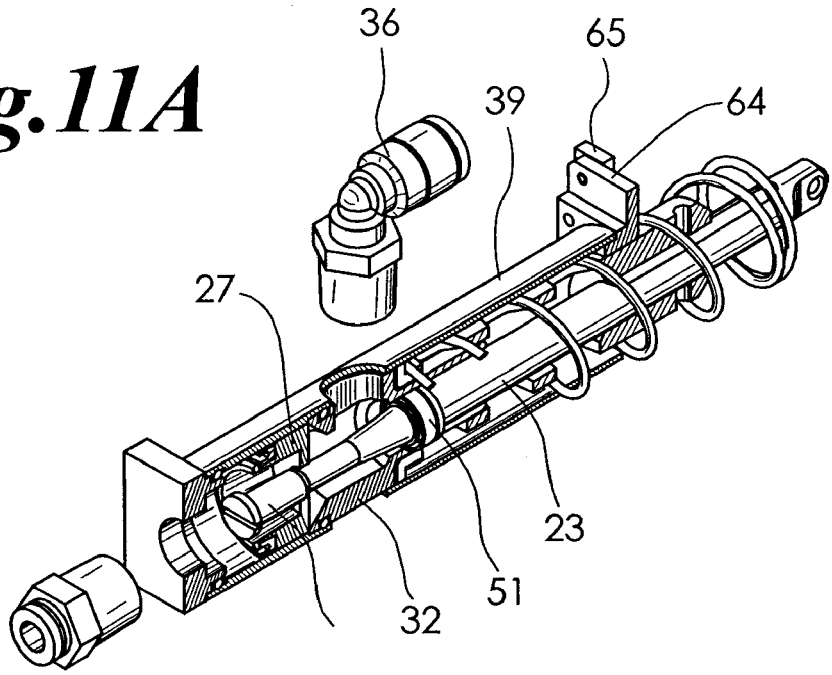
FIG. 11A is a sectional perspective view of a half part of the choke valve device (one-way valve mechanism and two-way valve mechanism) used in the fourth embodiment in FIG. 8.
Figure 11B:
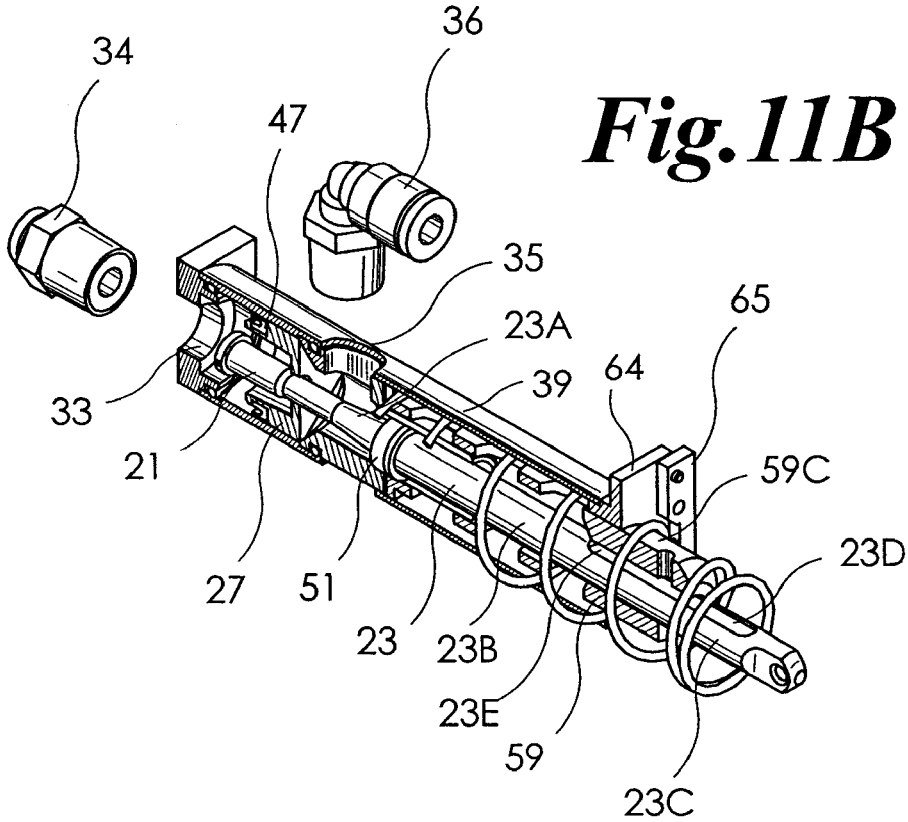
FIG. 11B is an exploded perspective view of a state viewed from the direction 90° different from that in FIG. 11A.
Figure 12:
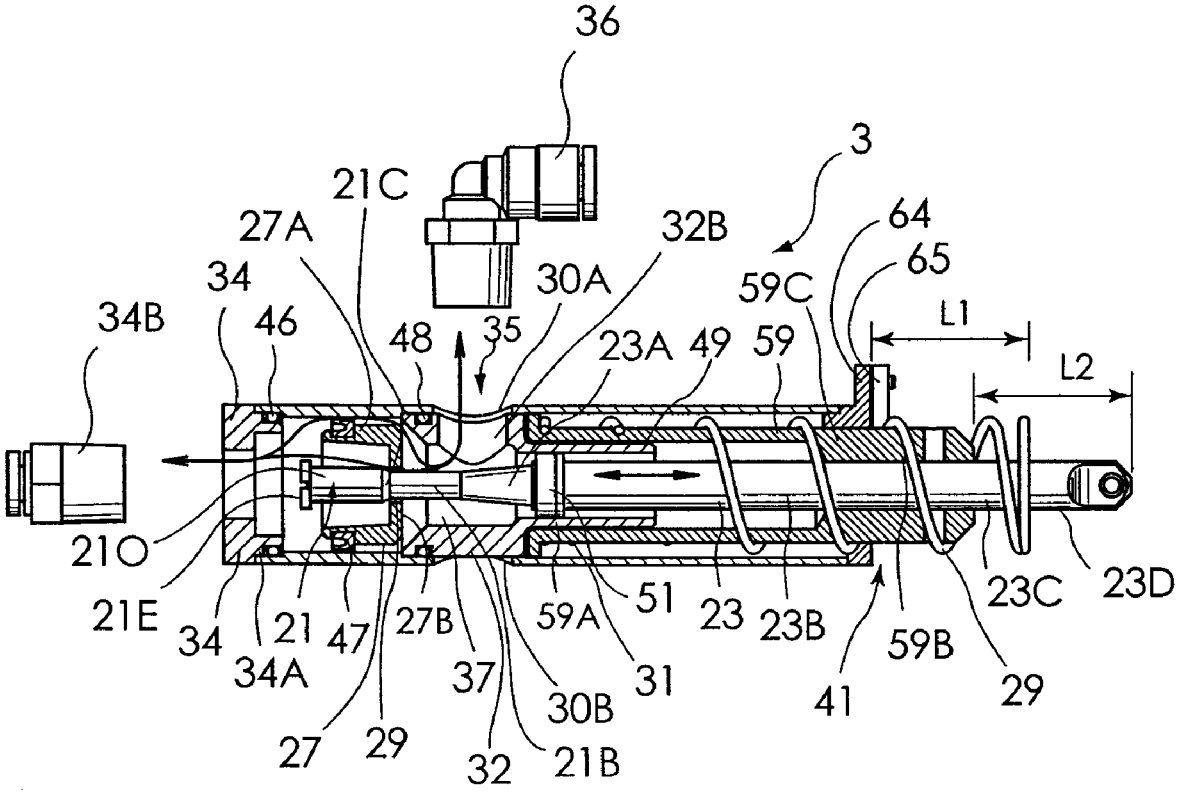
FIG. 12 is a longitudinal sectional view of the choke valve device (one-way valve mechanism and two-way valve mechanism) used in the fourth embodiment in FIG. 8.

Next, an example of the choke valve device 303, 305, which is used for the actuator using the fluid cylinder of the present invention, will be described. FIG. 9 is a perspective view of the choke valve device 303, 305 used in the embodiment of the present invention, a part of which is exploded; FIG. 10A is an exploded perspective view of the choke valve device 303, 305 in FIG. 9; FIG. 10B is an exploded perspective view thereof viewed from the direction 90° different from that in FIG. 10A; FIG. 11A is a perspective view of a cross section of the choke valve device 303, 305 in FIG. 9; FIG. 11B is an exploded perspective view thereof viewed from the direction 90° different from that in FIG. 11A; and FIG. 12 is a vertical sectional view of the choke valve device 303, 305 in FIG. 9. In these figures, a member given with a reference numeral 30 is a housing of the choke valve device 303, 305.

The housing 30 is provided with a flow path body 32 therein. The flow path body 32 is fixed to the housing 30 with screws 38. The flow path body 32 is integrally constructed of a cylindrical body part 32A having a flow path therein and a cylindrical cylinder section 49 (describe later). The internal space of the body part 32A and the internal space of the cylinder section 49 are communicated with each other. In the peripheral area of the body part 32A, a through hole 32B, which goes through the peripheral wall in the radial direction, is formed; and an o-ring engagement groove 32C extending in the peripheral direction is formed. An o-ring 48 is engaged with the o-ring engagement groove 32C. The housing 30 has a through hole 30A, which goes through the same in the radial direction at a position corresponding to the through hole 32B formed in the flow path body 32. Also, in the housing 30, another through hole 30B is formed at a position opposite to the through hole 30A in the radial direction; and further, in the rear half portion of the housing 30, six through holes 30C facing to each other aligned in the longitudinal direction are formed in the radial direction. These through holes 30C contribute to reduce the weight of the housing 30 and function as air release holes when a coil spring member 29 (described later) is displaced. Note that the coil spring member 29 functions as a spring member in the present invention.

Fixed to the front-end portion of the housing 30 is a first joint member 34. The first joint member 34 has a body part 34A, which is formed with an annular portion 34*a* to be engaged with the front-end portion of the housing 30. In the peripheral area of the annular portion 34*a*, an annular groove to be engaged with an o-ring 46 is formed. Also, a conduit connection nozzle 34B is engaged with the body part 34A of the first joint member 34. The conduit connection nozzle 34B constitutes a first connection port 33 to be connected to the corresponding chamber 9, 11. Further, the through hole 30A of the housing 30 and the through hole 32B of the flow path body 32 are aligned to constitute a second connection port 35 to be connected to the fluid pressure source (not shown). A second joint member 36 for connecting the choke valve device 303, 305 and the fluid pressure source is engaged with the second connection port 35 and fixed thereto. Note that a device body 39 with an inner flow path 37, which is positioned between the first connection port 33 and the second connection port 35 and allows the fluid to flow therethrough, is constructed of the front portion of the housing 30 and the flow path body 32. A spring member mounting structure 41 for mounting a coil spring member 29 is provided to the device body 39.

Figure 14A:
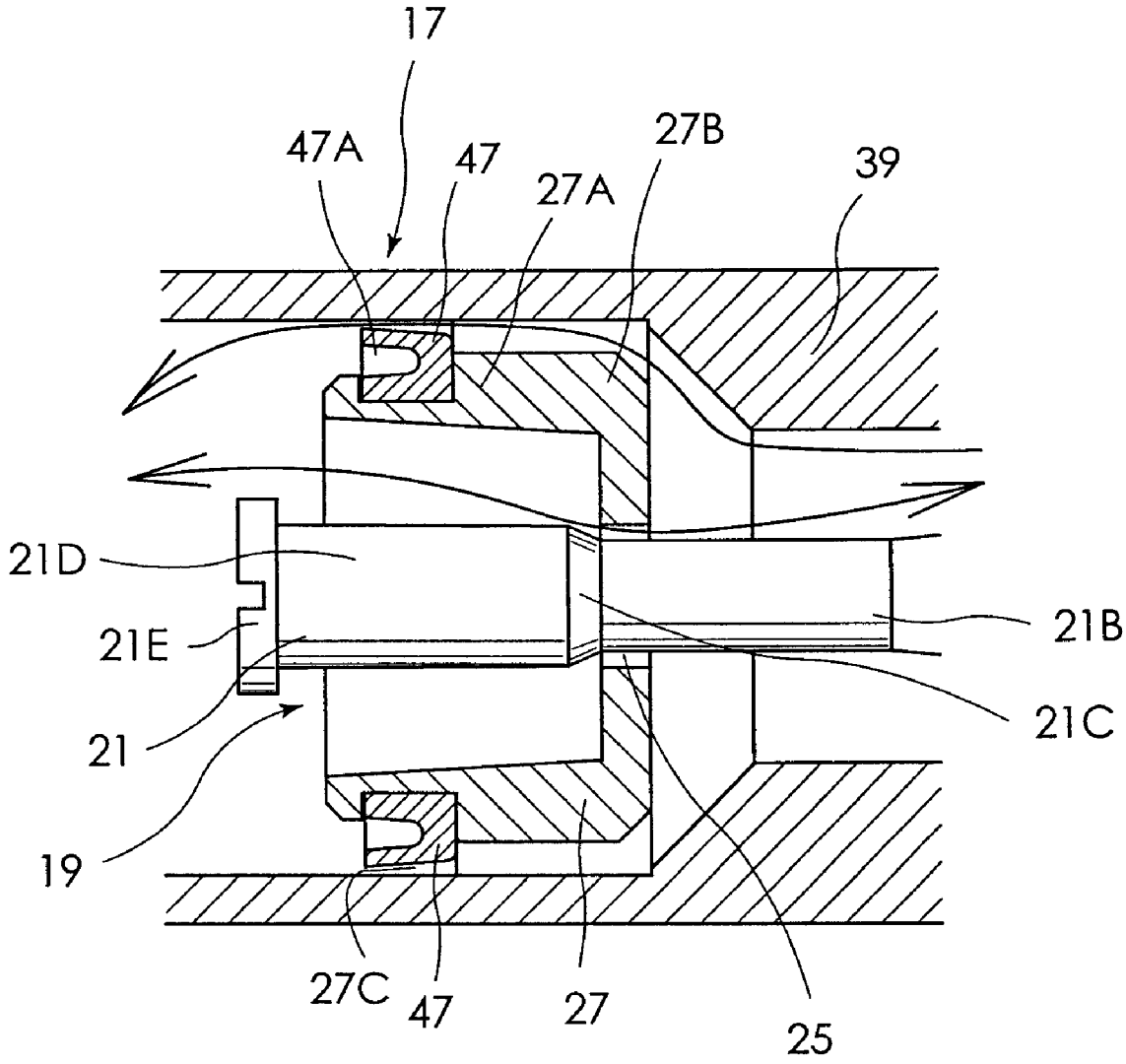
FIG. 14A is an enlarged cross sectional view of a part of a restriction mechanism of the choke valve device used in the fourth embodiment in FIG. 8 (when the opening of the two-way valve mechanism is full-open).

Inside of the housing 30, a restriction member 27 generally called as orifice is disposed between the flow path body 32 and the first joint member 34. The restriction member 27 comprises a cylindrical peripheral wall section 27A and a bottom wall section 27B closing one end of the cylindrical peripheral wall section 27A. Formed in the bottom wall section 27B is a through hole 25 for allowing a moving needle 21 to movably penetrate therethrough. As shown in FIG. 14, the restriction member 27 has such an outer dimension that the restriction member 27 comes into contact with a tapered surface formed inside of the opening formed in the front end of the flow path body 32 to restrict the restriction member's s backward movement. As shown in an enlarged figure FIG. 14A, an annular groove 27C is formed in the peripheral area of the peripheral wall section 27A of the restriction member 27. A rubber valve 47 of the one-way valve mechanism 17, 17' is engaged with the groove 27C and fixed thereto. The rubber valve 47 is disposed between the inner wall portion (inner wall portion of the housing 30) of the device body enclosing the inner flow path 37 and the restriction member 27 and operates with using the inner wall portion as the valve seat. The valve 47 has an annular shape and is formed with a groove 47A; and the groove 47A has a V-like shape in cross section and opens toward the front end of the housing 30.

A part of the moving needle 21 goes through the through hole 25 of the restriction member 27. The moving needle 21 has a screwed end portion 21A at the fixed side, which is screwed with the front-end portion of a rod 23 (described later) and fixed thereto; a portion 21B having a diameter larger than that of the screwed end portion 21A; an annular tapered portion 21C, which continues to the portion 21B and expands toward the front side; a portion 21D, which continues to the tapered portion 21C and positioned inside of the restriction member 27; and a head portion 21E, which is formed continuously with the portion 21D and formed with a screw-driver slot 21F. When the front end of a flat head screw driver is engaged with the screw-driver slot 21F and rotated, the moving needle 21 is screwed into a screw hole portion (not shown) formed in the front end of the rod 23 with the screwed end portion 21A. When the portion 21D positioned in front of the tapered portion 21C is engaged with the through hole 25, and when the head portion 21E of the restriction member 27 is brought into contact with the bottom wall section 27B, the flow of the fluid passing through the through hole 25 is completely stopped. When the position of the moving needle 21 is changed, and when the gap dimension between the tapered portion 21C or portion 21D and the edge portion of the through hole 25 varies, the flow rate of the fluid passing through the through hole 25 is adjusted. In this example, the two-way valve mechanism 19, 19' is constructed of the moving needle 21 and the restriction member 27.

The rod 23 includes a front end portion 23A fixed with the moving needle 21, a rod body 23B engaged with piston section 51 (described later) which is fixed thereto and a protruding end 23C protruding to the outside of the housing 30. In a portion near the protruding end 23C of the rod body 23B, engagement groove 23D is formed along the longitudinal direction of the rod 23. The piston section 51 fixed to the rod body 23B of the rod 23 is slidably engaged with the cylinder section 49 therein, which is formed integrally with the flow path body 32.

The rod 23 is constantly energized by the coil spring member 29. The coil spring member 29 constantly applies an energizing force to the rod 23 for moving the moving needle 21 in the direction where the flow rate of the fluid passing through the through hole 25 of the restriction member 27 increases. This actuator device is provided with a fluid-driven rod shifting mechanism 31 that shifts the rod 23 against the energizing force of the coil spring member 29 using the pressure of the fluid supplied from the fluid pressure source in order to shift the moving needle 21 in the direction where the flow rate of the fluid passing through the through hole 25 of the restriction member 27 decreases. In particular, the fluid-driven rod shifting mechanism 31 comprises a cylinder section 49, which is communicated with the inner flow path 37 of the device body 39, and a piston section 51 fixed to the rod 23, which slides within the cylinder section 49. As the pressure within the flow path body 32 increases due to the pressure of the fluid from the fluid pressure source, the piston section 51 moves in the direction away from the restriction member 27 against the energizing force of the coil spring member 29. The coil spring member 29 is mounted to the housing 30 with the spring member mounting structure 41. When the piston section 51 maximally moves in the direction away from the restriction member 27, the moving needle 21 completely closes the through hole 25.

The spring member mounting structure 41 is arranged so that the energizing force of the coil spring member 29 works on the protruding end 23C constituting the outer portion of the rod 23 extending out of the cylinder section 49. The coil spring member 29 used in this example is disposed in a compressed state with an internal end at the device body 39 and an external end at the external end of the rod 23. The spring member mounting structure 41 comprises a cylindrical member 59 and a spring member intermediate portion holding structure 61. In the cylindrical member 59, the main body thereof is disposed in the housing 30 and one end is fitted with the cylinder section 49. At the one end (internal end) of the cylindrical member 59, a flange portion 59A constituting an engaging portion is integrally formed; and the internal end of the coil spring member 29 is fixed to the flange portion 59A. In the other end (external end) of the cylindrical member 59, an engagement hole 59B is formed so as to be tightly engaged with the portion formed with the engagement groove 23D on the rod 23. When the portion 59C formed with the engagement hole 59B is fitted with a surface 23E adjacent to the inner end of the engagement groove 23D on the rod 23, the rod 23 and the cylindrical member 59 are positioned with respect to each other. The rod 23 and the cylindrical member 59 are moved together.

Figure 13:
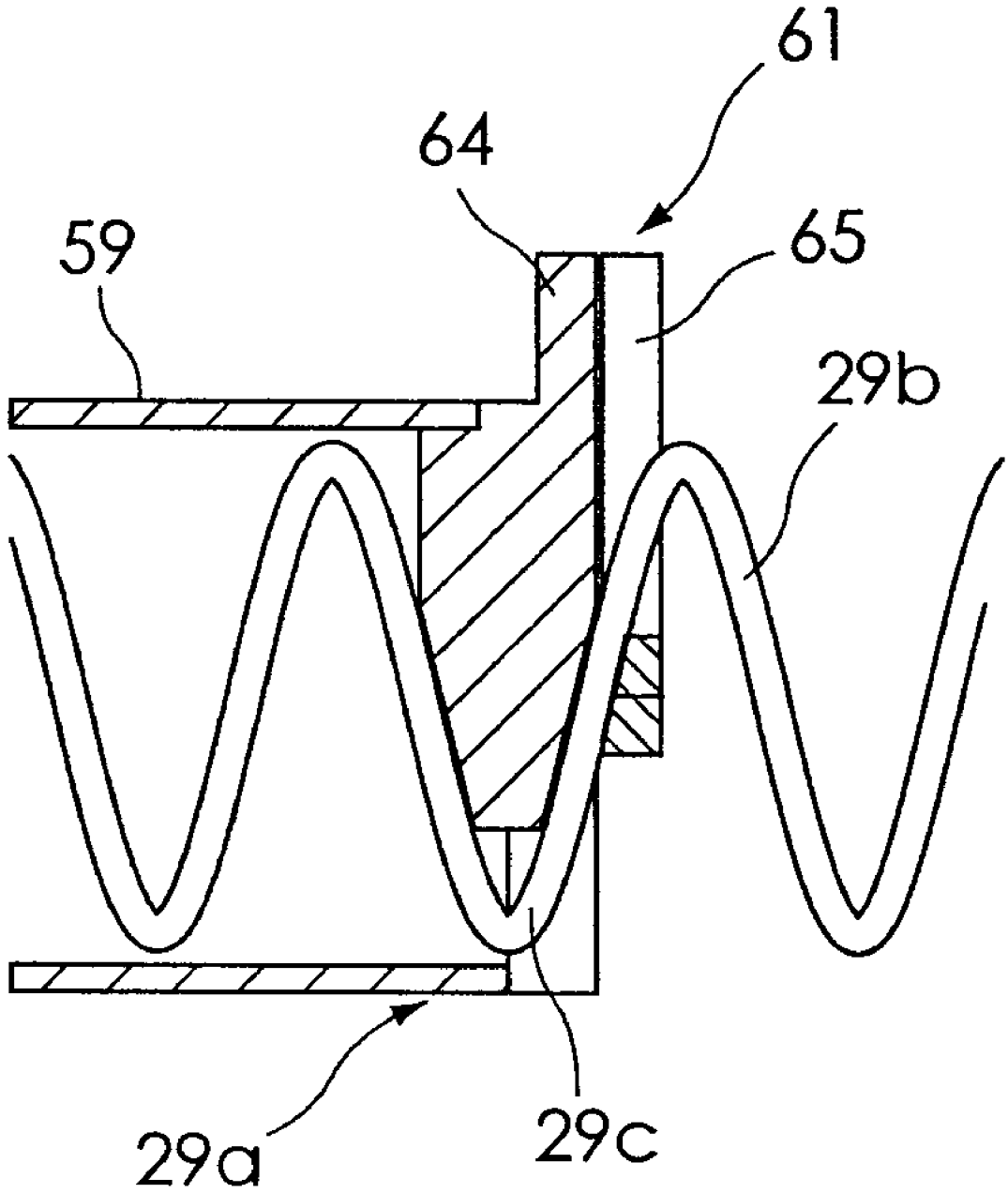
FIG. 13 is a sectional plane view of a half part of a spring member intermediate portion holding structure used in the fourth embodiment in FIG. 8.

The spring member intermediate portion holding structure 61 is positioned at the outer side of the portion 59C of the cylindrical member 59, and fixed to the end portion of the housing 30 so as not to displace with respect to the device body 39, and is arranged so as to hold the intermediate portion 29*a* of the coil spring member 29. In this example, the spring member intermediate portion holding structure 61 is arranged so that the holding position of the intermediate portion 29*a* of the coil spring member 29 can be changed. In particular, as shown in FIG. 13, the spring member intermediate portion holding structure 61 comprises a wedge member 64, which is inserted between two neighboring turn portions 29*b* and 29*c* of the coil spring member 29, and a nipping member 65 attached to the wedge member 64. The wedge member 64 is fixed to the housing 30 with an adhesive. As for the method of fixing the wedge member 64 to the housing 30, it is needless to say that an appropriate fixing means such as welding may be adopted. The nipping member 65 is fixed to the wedge member 64 with a screw so as to nip a part of the turn portion of the coil spring member 29. Owing to this, the coil spring member 29 is prevented from rotating. In a state that the nipping member 65 is removed from the wedge member 64, the wedge member 64 is disposed in a state that the coil spring member 29 can be rotated around the cylindrical member 59. When the coil spring member 29 is rotated, relative position of the wedge member with respect to the coil spring member 29 is changed. As a result, controlling characteristic of the actuator can be arbitrarily adjusted by changing the number of turns of the coil spring member 29 positioned between the wedge member 64 and the flange portion 59A constituting the engaging portion. The coil spring member 29 is transformed using a surface of the wedge member 64 opposite to the other surface of the wedge member 64 to which the nipping member 65 is fixed, as the support point.

Figure 14B:
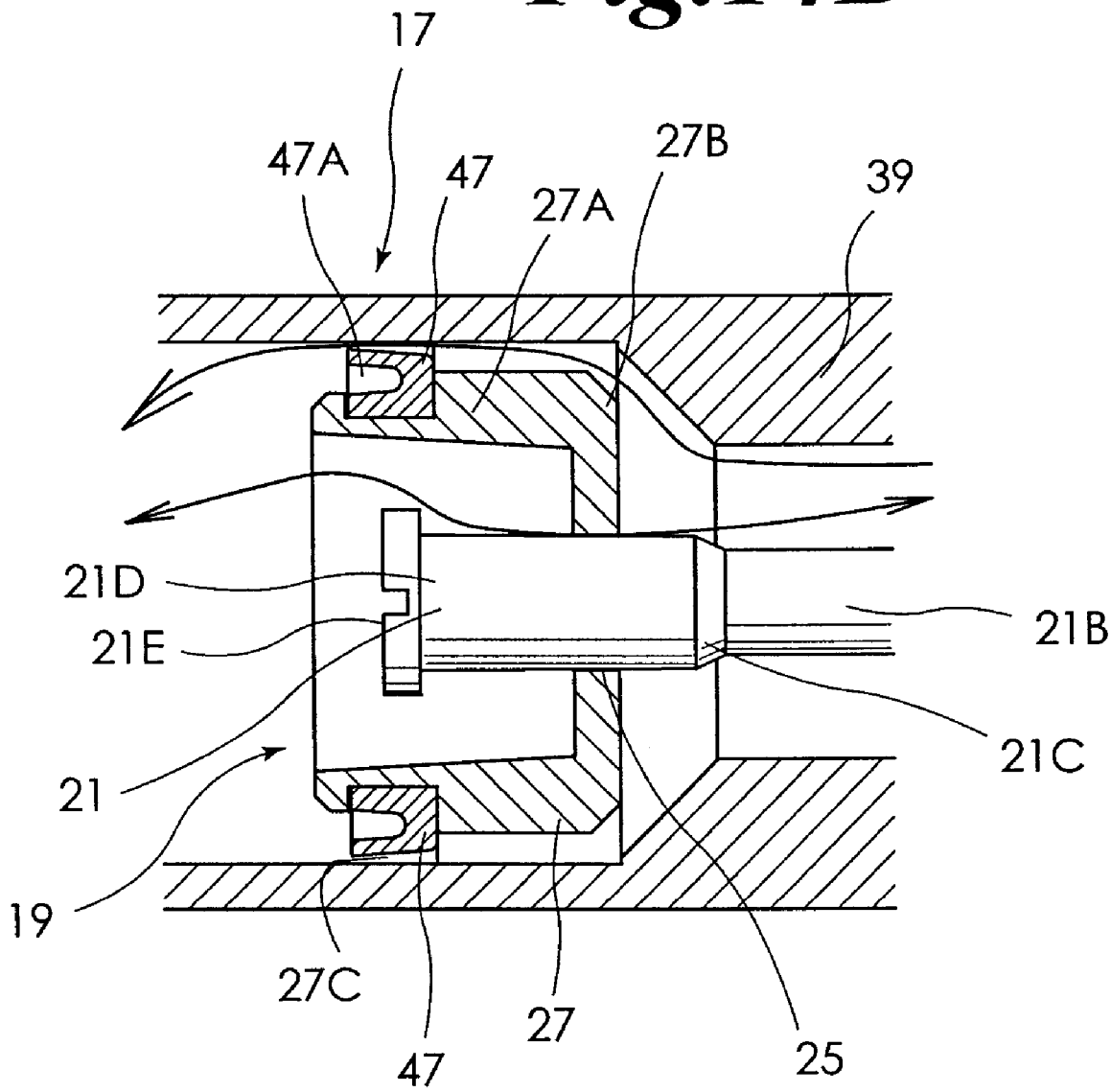
FIG. 14B is an enlarged cross sectional view of the part of a restriction mechanism of the choke valve device used in the fourth embodiment in FIG. 8 (when the opening of the two-way valve mechanism is half-open).
Figure 14C:
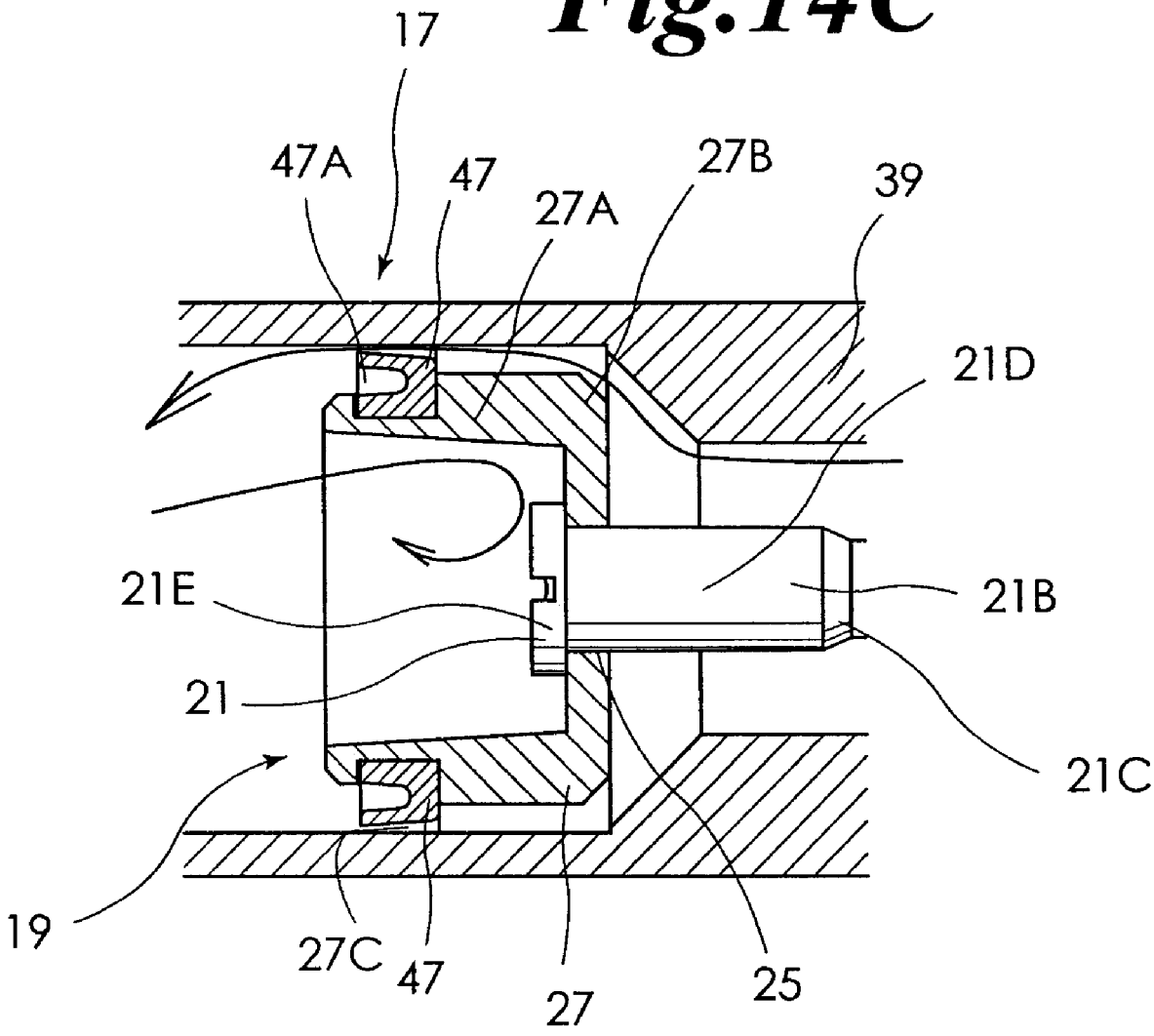
FIG. 14C is an enlarged cross sectional view of the part of the restriction mechanism of the choke valve device used in the fourth embodiment in FIG. 8 (when the opening of the two-way valve mechanism is shut down).

FIGS. 14A to 14C are cross sectional views of the restriction member 27 partially enlarged each showing a state that the opening of the two-way valve mechanism 19 in the first choke valve device 303, which is used in the above described embodiment, is full-open, half-open and shutdown respectively. Referring to FIGS. 14A to 14C, the valve mechanisms 17 and 19 in the first choke valve device 303 will be described. In this embodiment, the stroke of the moving needle 21 is prescribed to be movable by 10 mm maximum. When the pressure of the fluid in the chamber 9, 11 is zero, the moving needle 21 is positioned at the left end; and the opening of the two-way valve mechanism 19 is full-open (FIG. 14A). At the same time, the opening of the one-way valve mechanism 17 is also full open. As the pressure of the fluid in the chamber 9, 11 is getting larger than zero, the moving needle 21 moves rightward (FIG. 14B); at the same time, the opening of the two-way valve mechanism also becomes smaller. When the pressure of the fluid in the chamber 9, 11 reaches a specific pressure or more, as shown in FIG. 14C, the moving needle 21 is positioned at the right end, and the two-way valve mechanism 19 is completely shut down.

When the relative position of the wedge member 64 with respect to the coil spring member 29 is changed, the opening of the two-way valve mechanism 19 is full-open and the moving needle 21 is positioned at the left end. In this state, since the energizing force of the coil spring member 29 becomes zero and the contact between the internal end of the coil spring member 29 and the flange portion 59A is maintained, the relative position between the rod 23 and the cylindrical member 59 can be also changed simultaneously. To change the relative position between the rod 23 and the cylindrical member 59, a setscrew 43 securing therebetween is loosened once; and then, the cylindrical member 59 is slided along the engagement groove 23D. An appropriately set position can be easily determined by measuring the length L2 between the external end of the cylindrical member 59 and the external end of the rod 23 as shown in FIG. 12.

Next, control method of the actuator using the fluid cylinder 1 in the embodiment of the present invention will be described. For example, when the position of the piston 12 is moved by positively supplying the fluid from the fluid pressure source into the cylinder chamber 7 through the second choke valve device 305, it is assumed that the stiffness of the fluid cylinder is determined by restricting the flow rate of the fluid toward the output direction in the two-way valve mechanism 19 of the first choke valve device 303. In this case, the fluid is positively supplied to the first choke valve device 303 from the fluid pressure source to move the piston section 51 provided to the rod 23 and to positively shut down the through hole of the restriction member 27 (orifice) with the moving needle 21; thereby the piston of the fluid cylinder 1 can be stopped. As described above, by adjusting the opening of the two-way valve mechanism 19, 19' of the choke valve device 303, 305, the stiffness and stop position of the fluid cylinder 1 can be easily determined arbitrarily.

INDUSTRIAL APPLICABILITY

According to the present invention, the fluid cylinder can be given with stiffness by adjusting the opening of the valve in the discharge valve mechanism of the choke valve device. Accordingly, the present invention enables the fluid cylinder to be practically applied to a robot or the like as a driving actuator of a control device thereof.

The invention claimed is:

1. An actuator using a fluid cylinder, comprising:

a fluid cylinder having a cylinder chamber and a piston slidably disposed in the cylinder chamber so as to partition the cylinder chamber into a first chamber and a second chamber;

a first choke valve device disposed between a fluid pressure source and the first chamber to adjust a fluid pressure in the first chamber; and a second choke valve device disposed between the fluid pressure source and the second chamber to adjust a fluid pressure in the second chamber, each of the first choke valve device and the second choke valve device including a supply valve mechanism that permits the fluid to flow in the input direction from the fluid pressure source to the corresponding chamber and a discharge valve mechanism that permits the fluid to flow in the output direction from the chamber to the fluid pressure source, at least the discharge valve mechanism being capable of varying the opening of the valve, wherein both of the supply valve mechanism and the discharge valve mechanism are constructed within a hybrid valve mechanism that comprises a pressure control valve mechanism; a one-way valve mechanism that permits the fluid to flow only in the input direction from the fluid pressure source to the corresponding chamber side through the pressure control valve mechanism; and a two-way valve mechanism that permits the fluid to flow in the two directions; i.e., in the input direction from the fluid pressure source to the chamber through the pressure control valve mechanism and in the output direction from the chamber to the fluid pressure source, the two-way valve mechanism being arranged so that the opening of the valve can be varied depending on the pressure of the fluid supplied from the fluid pressure source.

2. A control method of an actuator using a fluid cylinder set forth in claim 1, wherein, when the position of the piston in the fluid cylinder is shifted by positively supplying the fluid through one of the first and second choke valve devices from the fluid pressure source into the cylinder chamber, the flow rate of the fluid toward the output direction of the two-way-valve mechanism in the discharge valve mechanism of each of the first and second choke valve devices is restricted and thereby the mobility of the piston of the fluid cylinder due to the external force or the stiffness of the fluid cylinder is determined.

3. A control method of an actuator using a fluid cylinder set forth in claim 1, wherein, when the position of the piston in the fluid cylinder is shifted by positively supplying the fluid through one of the first and second choke valve devices from the fluid pressure source into the cylinder chamber, the flow rate of the fluid toward the output direction of the two-way-valve mechanism in the discharge valve mechanism of each of the first and second choke valve devices is restricted and thereby the mobility of the piston of the fluid cylinder due to the external force or the stiffness of the fluid cylinder is determined.

4. A control method of an actuator using a fluid cylinder set forth in claim 3, wherein the fluid is positively supplied from the fluid pressure source to the choke valve device to shift the piston section provided to the rod to positively close the through hole of the restriction member with the moving needle, thereby the piston of the fluid cylinder is stopped.

5. The actuator using a fluid cylinder according to claim 1, wherein the two-way valve mechanism comprises:

a rod equipped with a moving needle;

a restriction member that has a through hole through which the moving needle movably penetrates and with which the flow rate of the fluid passing through the through hole is controlled depending on the position of the moving needle;

a spring member that constantly applies an energizing force to the rod for shifting the moving needle in the direction that the fluid passing through the through hole increases; and a fluid-driven rod shifting mechanism that causes the rod to shift against the energizing force of the spring member by means of a pressure of the fluid supplied from the fluid pressure source to shift the moving needle in the direction that the flow rate of the fluid passing through the through hole of the restriction member decreases.

6. The actuator using a fluid cylinder according to claim 5, wherein each of the first and second choke valve devices includes:

a device body having a first connection port connected to the corresponding chamber, a second connection port, which is connected to the fluid pressure source and an inner flow path positioned between the first connection port and the second connection port through which the fluid flows, and a spring member mounting structure for mounting the spring member to the device body, wherein the restriction member and a part of the rod equipped with the moving needle are disposed within the inner flow path of the device body, and wherein a valve of the one-way valve mechanism is provided to a peripheral portion of the restriction member, the valve being positioned between an inner wall portion of the device body enclosing the inner flow path and the peripheral portion and operating by means of the inner wall portion as the valve seat.

7. The actuator using a fluid cylinder according to claim 6, wherein, the fluid-driven rod shifting mechanism comprises a cylinder section communicated with the inner flow path formed within the device body and a piston section provided to the rod, the piston section sliding in the cylinder section, and wherein the spring member mounting structure is structured so that the energizing force of the spring member works on the outer portion of the rod extending from the cylinder section.

8. The actuator using a fluid cylinder according to claim 7, wherein the second connecting port is disposed so as to be communicated with the flow path positioned between the restriction member and the cylinder section.

9. The actuator using a fluid cylinder according to claim 7, wherein the spring member is comprised of a coil spring member disposed in a compressed state and has the internal end at the device body side and the external end at the external end side of the rod, and wherein the spring member mounting structure includes a cylindrical member that is positioned inside the coil spring member and fixed to the outer portion of the rod and moves along with the rod, and is the cylindrical member being provided with an engaging portion to be engaged with the internal end of the coil spring member, and a spring member intermediate portion holding structure that is positioned at the outer side of the cylindrical member, and is arranged so as not to shift with respect to the device body and so as to hold an intermediate portion of the coil spring member, and wherein the spring member intermediate portion holding structure is constructed in such a manner that the number of turns within a section in the coil spring member which is held between the engaging portion and the structure can be changed by varying the holding position of the intermediate portion of the coil spring member, the section of the coil spring member acting as a compressed spring.

10. The actuator using a fluid cylinder according to claim 9, wherein the spring member intermediate portion holding structure has a wedge member inserted between neighboring two turn portions of the coil spring member, and the wedge member is disposed so as to allow the coil spring member to be rotated on the cylindrical member.

11. A choke valve device suitable for being used as a first choke valve device or a second choke valve device of an actuator comprising a fluid cylinder that has a cylinder chamber and a piston disposed slidably in the cylinder chamber so as to partition the cylinder chamber into a first chamber and a second chamber, the first choke valve device disposed between a fluid pressure source and the first chamber for adjusting the fluid pressure within the first chamber; and the second choke valve device disposed between the fluid pressure source and the second chamber for adjusting the fluid pressure within the first chamber comprises;

a one-way valve mechanism that permits the fluid to flow only in the input direction from the fluid pressure source to the corresponding chamber side, and a two-way valve mechanism that permits the fluid to flow in the two directions; i.e., in the input direction from the fluid pressure source to the chamber and in the output direction from the chamber to the fluid pressure source side, wherein the two-way valve mechanism comprises:

a rod equipped with a moving needle;

a restriction member that has a through hole through which the moving needle movably penetrates, and with which the flow rate of the fluid passing through the through hole is controlled depending on the position of the moving needle;

a spring member that constantly applies an energizing force to the rod for shifting the moving needle in the direction that the fluid passing through the through hole increases;

a fluid-driven rod shifting mechanism that causes the rod to shift against the energizing force of the spring member by means of the pressure of the fluid supplied from the fluid pressure source to shift the moving needle in the direction that the flow rate of the fluid passing through the through hole of the restriction member decreases; and a spring member mounting structure capable of adjusting the number of turns within a section in the spring member which functions as a compressed spring.

* * * * *

UNITED STATES PATENT AND TRADEMARK OFFICE

CERTIFICATE OF CORRECTION

PATENT NO. : 7,392,734 B2
APPLICATION NO. : 10/595712
DATED : July 1, 2008
INVENTOR(S) : Ichiro Kawabuchi et al.

It is certified that error appears in the above-identified patent and that said Letters Patent is hereby corrected as shown below:

Column 19, Line 14 (Claim 11, Line 12), Delete “first”, Insert --second--.

Signed and Sealed this

Sixteenth Day of September, 2008

JON W. DUDAS
*Director of the United States Patent and Trademark Office*